US007344219B2

(12) United States Patent
Sakamoto et al.

(10) Patent No.: US 7,344,219 B2
(45) Date of Patent: Mar. 18, 2008

(54) INK JET PRINTING APPARATUS AND INK JET PRINTING METHOD

(75) Inventors: Atsushi Sakamoto, Kawasaki (JP); Norihiro Kawatoko, Kawasaki (JP); Yuji Hamasaki, Kawasaki (JP); Hidehiko Kanda, Yokohama (JP); Toshiyuki Chikuma, Kawasaki (JP); Aya Hayashi, Sendai (JP); Jiro Moriyama, Kawasaki (JP); Masashi Hayashi, Sagamihara (JP); Hirokazu Tanaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/480,556

(22) Filed: Jul. 5, 2006

(65) Prior Publication Data

US 2007/0013732 A1 Jan. 18, 2007

(30) Foreign Application Priority Data

Jul. 8, 2005 (JP) ..... 2005-200146
Jun. 21, 2006 (JP) ..... 2006-171692

(51) Int. Cl.
*B41J 29/393* (2006.01)

(52) U.S. Cl. ..... 347/19; 347/9; 347/41

(58) Field of Classification Search ..... 347/16, 347/19, 41

See application file for complete search history.

(56) References Cited

U.S. PATENT DOCUMENTS 5,956,055 A 9/1999 Gibson et al. ..... 347/40
6,241,334 B1 * 6/2001 Haselby ..... 347/19

FOREIGN PATENT DOCUMENTS

JP 7-40551 2/1995
JP 07040551 A * 2/1995
JP 11-240143 9/1999
JP 11240143 A * 9/1999

* cited by examiner

*Primary Examiner*—Lamson Nguyen
*Assistant Examiner*—Justin Seo
(74) *Attorney, Agent, or Firm*—Fitzpatrick, Cella, Harper & Scinto

(57) ABSTRACT

When a printing position is displaced by an inclination of a printing head, for example, the displacement can be corrected in an easy and effective manner and a user can easily recognize the displacement of the printing position to correct the displacement. To realize this, dots for forming a test pattern are formed by different scannings by a nozzle group including a plurality of nozzles positioned at one end side of a nozzle row and a nozzle group including a plurality of nozzles positioned at the other end side of the nozzle row. Depending on displacements of the printing positions of these dots, the plurality of nozzles constituting the nozzle row are divided into a plurality of divided nozzle groups. Then, the printing position is adjusted on the basis of the divided nozzle groups.

16 Claims, 23 Drawing Sheets

| | CORRESPONDENCE BETWEEN A HEAD INCLINATION AMOUNT ESTIMATED BASED ON THE PATTERN AND AN ACTUAL HEAD INCLINATION AMOUNT | PATTERN VISUAL APPEARANCE |
|---|---|---|
| FIRST TEST PATTERN (PATTERN FOR COMPARING SINGLE DOTS PRINTED BY THE HIGHEST END NOZZLE AND THE LOWEST END NOZZLE) | × | × |
| SECOND TEST PATTERN (PATTERN FOR COMPARING SINGLE DOTS PRINTED BY THE HIGHEST END NOZZLE AND A NOZZLE THAT EJECTS INK SIMULTANEOUSLY WITH THE HIGHEST END NOZZLE AND THAT HAS THE LONGEST DISTANCE THEREFROM) | ○ | × |
| THIRD TEST PATTERN (PATTERN FOR COMPARING A PLURALITY OF DOTS PRINTED BY THE UPPER END NOZZLE GROUP AND THE LOWER END NOZZLE GROUP THAT EJECTS INK SIMULTANEOUSLY WITH THE UPPER END NOZZLE GROUP AND THAT HAS THE LONGEST DISTANCE THEREFROM) | ○ | ○ |

FIG.8

| | CIRCUIT CONFIGURATION AND THE CONTROL OF THE DRIVING OF A HEAD | VISUAL APPEARANCE OF A RULED LINE PATTERN BY ONE PASS PRINTING | IMAGE ROUGHNESS BY FOUR PASS PRINTING (MAIN SCANNING WITH 1200 dpi) | IMAGE ROUGHNESS BY SIX PASS PRINTING (MAIN SCANNING WITH 1200 dpi) |
|---|---|---|---|---|
| FIRST CORRECTION METHOD (IN THE CASE WHERE THE NUMBER AT WHICH THE NOZZLE ROW IS DIVIDED IS SET BASED ON THE DISPLACEMENT AMOUNT DETECTED BY THE FIRST TEST PATTERN) | COMPLICATED | × | × | × |
| SECOND CORRECTION METHOD (IN THE CASE OF THE FIRST EMBODIMENT OF THE PRESENT INVENTION) | EASY | ○ | ◎ | ○ |

FIG.10

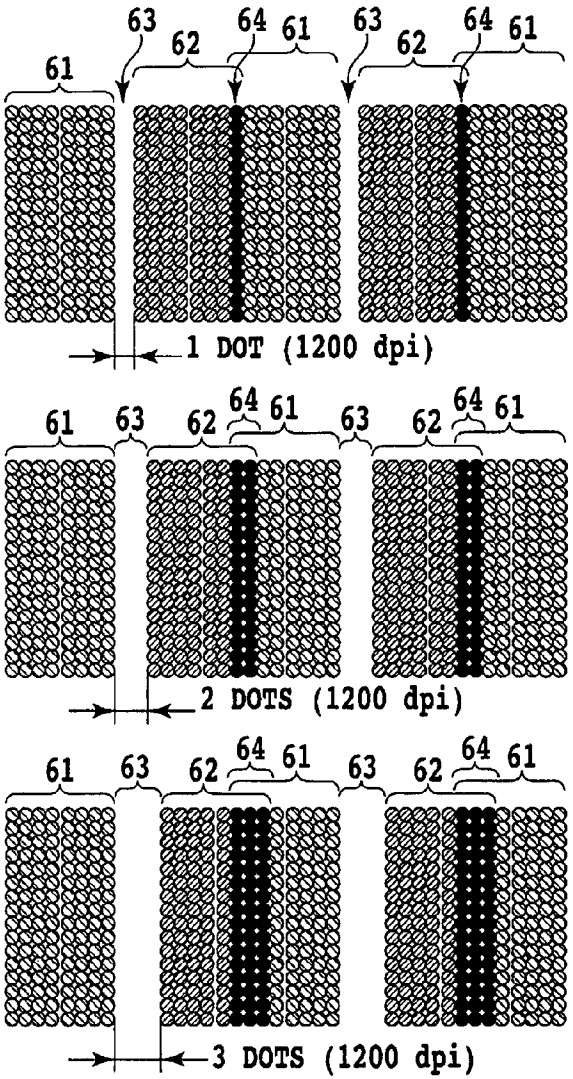
FIG.11C
FIG.11D
FIG.11E
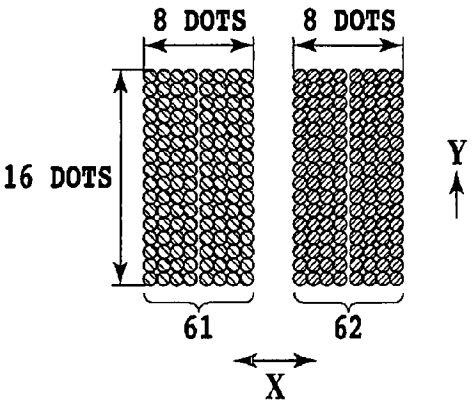
FIG.11A
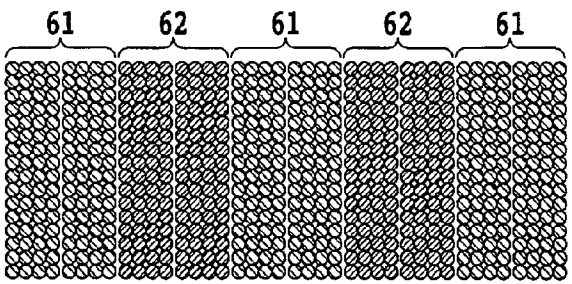
FIG.11B

| | CIRCUIT CONFIGURATION AND THE CONTROL OF THE DRIVING OF A HEAD | VISUAL APPEARANCE OF A RULED LINE PATTERN BY ONE PASS PRINTING | IMAGE ROUGHNESS BY FOUR PASS PRINTING (MAIN SCANNING WITH 1200 dpi) | IMAGE ROUGHNESS BY SIX PASS PRINTING (MAIN SCANNING WITH 1200 dpi) |
|---|---|---|---|---|
| FIRST CORRECTION METHOD (IN THE CASE WHERE THE NUMBER AT WHICH THE NOZZLE ROW IS DIVIDED IS SET BASED ON THE DISPLACEMENT AMOUNT DETECTED BY THE FIRST TEST PATTERN) | COMPLICATED | × | × | × |
| SECOND CORRECTION METHOD (IN THE CASE OF THE SECOND EMBODIMENT OF THE PRESENT INVENTION) | EASY | ○ | ○ | ◎ |

FIG.13

| | THE NUMBER n AT WHICH THE NOZZLE ROW IS DIVIDED | | |
|---|---|---|---|
| | NO (L1) | 2 (L2) | 3 (L3) |
| LEVEL OF REDUCTION OF IMAGE ROUGHNESS | × | ○ | × |

FIG.23

INK JET PRINTING APPARATUS AND INK JET PRINTING METHOD

BACKGROUND OF THE INVENTION

1. Field of the Invention

The present invention relates to an ink jet printing apparatus and an ink jet printing method by which a printing head that can eject ink is used to print an image on a printing medium such as a paper or plastic.

2. Description of the Related Art

At present, ink jet printing apparatuses have been widely used in the copy and facsimile fields due to the improved image quality and the reduced printing time enabled by smaller ink dots.

In order to print an image with a higher resolution and a reduced printing time, nozzles may be arranged with a high density or a long printing head may be used. In this case, an attachment error caused when printing head is arranged with an error and an application error caused when chip is applied in a printing head with an error (chip in which nozzles are provided) for example have a significant influence on an image quality of a printed image. For example, a case is assumed where a printing apparatus using a plurality of printing heads for a multicolor full color printing or the like is structured so that one of the plurality of printing heads is attached to another printing head with an inclination. In this case, dot formed by the inclined printing head is superposed with dot of a neighboring pixel printed by the another printing head, which may cause a risk where a printed image has a degraded appearance quality. When a single printing head is used for a printing operation and when the printing head has an inclination with a level equal to or higher than a certain level, a resultant image may have a degraded appearance quality. In the case of a serial type printing apparatus in particular, boundaries among the respective printing/scanning regions may be conspicuous.

When the printing head has an inclination (i.e., when the nozzle row has an inclination) as described above, a risk may be caused where positions at which ink droplets are adhered (a position at which ink dots are formed) may be displaced to deteriorate a resultant image. One of methods for preventing this is to detect a displacement amount of a dot formation position to control, based on the detection result, a timing at which a printing head ejects ink. Another method is to shift a relation between a position to which a printing head of a serial type printing apparatus is moved in the main scanning direction and printing data for driving the printing head so that the displacement of a dot formation position due to the inclined nozzle row can be corrected. Methods for detecting a displacement amount of a dot formation position include, for example, the one for printing a test pattern such as a ruled line to detect the displacement amount based on the printing result. Another method for detecting a displacement amount of a dot formation position is to detect a displacement amount between dot formed by ink ejected from an end nozzle positioned at one end of a nozzle row and dot formed by ink ejected from an end nozzle positioned at the other end of the nozzle row. This detection method is disclosed, for example, in Japanese Patent Unexamined Publication No. H11-240143.

On the other hand, among the methods for reducing the deterioration of an image appearance quality based on the detection result of the displacement amount as described above, there is a method for changing a timing at which a nozzle of a printing head is driven. Japanese Patent Unexamined Publication No. H07-40551 discloses a method by which a plurality of nozzles arranged in a printing head are divided to a plurality of blocks so that the detection result of a dot displacement amount corresponding to an inclination of the printing head is used as a base for adjusting an order at which the respective blocks are driven (an order at which ink is ejected).

By the way, recent ink jet printing apparatuses in which a printing head can be exchanged by a user have a risk in which the printing head cannot be attached accurately and have another risk in which, whenever a printing head is attached, the printing head may be attached with a different inclination angle. Thus, the operation for correcting the displacement of the dot formation position due to the inclination of the nozzle row as described above may be performed with a higher frequency. Thus, the operation as described above must be easy-to-understand for users.

Furthermore, the method for detecting the displacement amount of the dot formation position disclosed in Japanese Patent Unexamined Publication No. 11-240143 has a problem as described below. Incidentally, this method detects, as described above, a displacement amount between dot formed by ink ejected from an end nozzle positioned at one end of a nozzle row and dot formed by ink ejected from an end nozzle positioned at the other end of the nozzle row.

Specifically, when both of end nozzles at one end and the other end eject ink simultaneously, displacement among dots formed by these inks most reflects an influence by the inclination of the nozzle row. However, these end nozzles in many cases do not eject ink simultaneously. Furthermore, even when these end nozzles eject ink simultaneously, it is difficult to accurately detect the displacement amount of a dot formation position. Specifically, end nozzles positioned at one end and the other end of a nozzle row tend to be influenced, when compared with other nozzles, by water evaporation of ink in the printing head. Thus, when an ink ejecting interval is long, ink ejecting deviation that shifts a direction along which ink is ejected tends to be caused. Furthermore, when an end nozzle and another nozzle collectively eject ink, the end nozzle tends to be influenced by air current caused by the collective ink ejection. This causes a risk where a direction along which ink is ejected from the end nozzle may be shifted.

On the other hand, in the case of the method as described in Japanese Patent Unexamined Publication No. 07-40551 in which a nozzle row is divided to a plurality of blocks to control the respective blocks, a risk may be caused where an extremely large inclination of the nozzle row prevents a minute correction to the predetermined number of divided blocks. For example, when a displacement amount between both end nozzles is large and when a predetermined number of divided blocks is two, correction for significantly improving the image appearance quality is difficult. As described above, a close relation has existed between an inclination of a nozzle row and the number of divided blocks of the nozzle row. However, this relation has been not considered.

SUMMARY OF THE INVENTION

It is an objective of the present invention to provide an ink jet printing apparatus and an ink jet printing method by which, when a printing position is displaced by an inclination of a printing head for example, the displacement can be corrected in an easy and effective manner and by which the displacement of the printing position can be easily recognized and corrected by a user.

In the first aspect of the present invention, there is provided an ink jet printing apparatus for printing an image on a printing medium by using a printing head having a nozzle row in which a plurality of nozzles that can eject ink are arranged to repeat a scanning and a transportation operation, the scanning being performed for causing the nozzle to eject ink while moving the printing head in a main scanning direction and the transportation operation being performed for transporting the printing medium in a sub scanning direction crossing the main scanning direction, the ink jet printing apparatus comprising:

setting means for setting a number at which the nozzle row is divided for dividing a plurality of nozzles constituting the nozzle row to a plurality of divided nozzle groups in accordance with a displacement amount in the main scanning direction between a first printed image printed, during first a scanning, by a first nozzle group including a plurality of nozzles positioned at one end side of the nozzle row and a second printed image printed, during a second scanning different from the first scanning, by a second nozzle group including a plurality of nozzles positioned at the other end side of the nozzle row; and correcting means for correcting a printing position on the basis of the divided nozzle groups divided in accordance with the number at which the nozzle row is divided.

In the second aspect of the present invention, there is provided an ink jet printing method for printing an image on a printing medium by using a printing head having a nozzle row in which a plurality of nozzles that can eject ink are arranged to repeat a scanning and a transportation operation, the scanning being performed for causing the nozzle to eject ink while moving the printing head in a main scanning direction and the transportation operation being performed for transporting the printing medium in a sub scanning direction crossing the main scanning direction, the ink jet printing method comprising the steps of:

printing a first printed image printed, during a first scanning, by a first nozzle group including a plurality of nozzles positioned at one end side of the nozzle row and a second printed image printed, during a second scanning different from the first scanning, by a second nozzle group including a plurality of nozzles positioned at the other end side of the nozzle row;

setting, in accordance with a displacement amount in the main scanning direction of the first printed image and the second printed image, a number at which the nozzle row is divided for dividing the plurality of nozzles constituting the nozzle row to a plurality of divided nozzle groups; and correcting a printing position on the basis of the divided nozzle groups divided by the number at which the nozzle row is divided.

According to the present invention, the first nozzle group including a plurality of nozzles positioned at one end of a nozzle row of a printing head and the second nozzle group including a plurality of nozzles positioned at the other end of the nozzle row are used to print the first printed image and the second printed image at different printings/scannings. Then, in accordance with a displacement amount between the first and second printed images, a plurality of nozzles constituting a nozzle row are divided to a plurality of divided nozzle groups to adjust the printing position on the basis of the divided nozzle groups. This can correct, when a printing position is displaced by an inclined printing head, the displacement in an easy and effective manner.

When a detection means having a half reading resolution of the printing resolutions of the first and second printed images is used in order to detect the displacement amount between the first and second printed images, nozzles can be divided to nozzle groups in an amount of N×2 in accordance with a displacement amount N detected by the detection means on the basis of the reading resolution. When a detection means having the same reading resolution as the printing resolutions of the first and second printed images is used in order to detect the displacement amount between the first and second printed images, nozzles can be divided to nozzle groups in an amount of M (M is a value other than 1) in accordance with a displacement amount M detected by the detection means on the basis of the reading resolution.

Furthermore, the first nozzle group and the second nozzle group do not include a nozzle positioned at the farthest end of a nozzle row. As a result, the first and second printed images can be printed without being influenced by the shift of an ink ejecting direction that tends to be caused at the farthest end.

Furthermore, the first and second nozzle groups including a plurality of nozzles are used to print the first and second printed images. Thus, the first and second printed images can be printed so that the displacement of the printing position can be easily recognized by a user. This allows a user, even when the printing head is attached with an inclination or when the inclination is changed whenever the printing head is attached, to easily recognize the displacement of the printing position to correct the printing position in accordance with the displacement.

The above and other objects, effects, features and advantages of the present invention will become more apparent from the following description of embodiments thereof taken in conjunction with the accompanying drawings.

BRIEF DESCRIPTION OF THE DRAWINGS

FIG. 8 illustrates the result of the comparison among different test patterns;

FIG. 10 illustrates the performance of the ink jet printing apparatus in the first embodiment of the present invention;

FIG. 11A illustrates a test pattern in a second embodiment of the present invention;

FIG. 11B, FIG. 1C, FIG. 1D, and FIG. 11E illustrate different printing results of test patterns corresponding to inclinations of the printing head, respectively;

FIG. 13 illustrates the performance of the ink jet printing apparatus in the second embodiment of the present invention;

FIG. 23 illustrates the performance of the ink jet printing apparatus in the third embodiment of the present invention.

DETAILED DESCRIPTION OF THE PREFERRED EMBODIMENT

Next, embodiments of the present invention will be described with reference to the drawings.

(1) First Embodiment

Hereinafter, a first embodiment of the present invention will be described.

(1-1) Basic Structure

Figure 1:
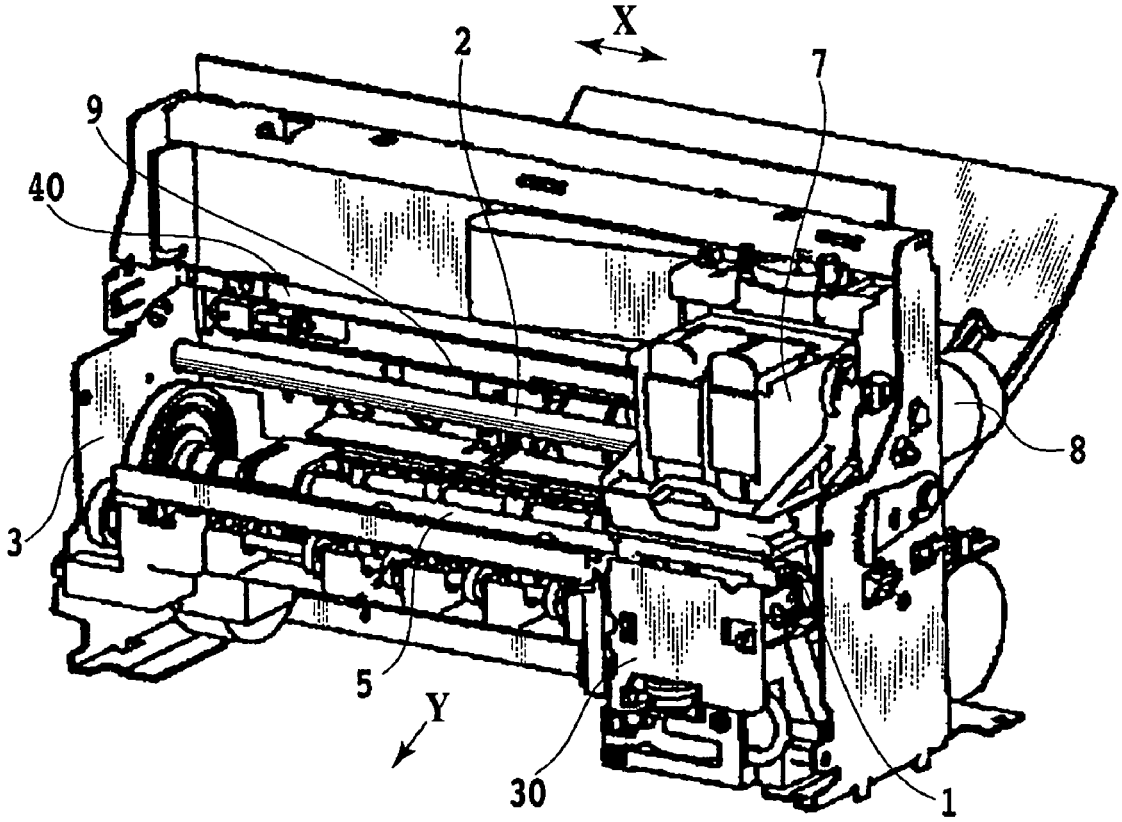
FIG. 1 is a perspective view illustrating the main part of an ink jet printing apparatus in a first embodiment of the present invention.
Figure 2:
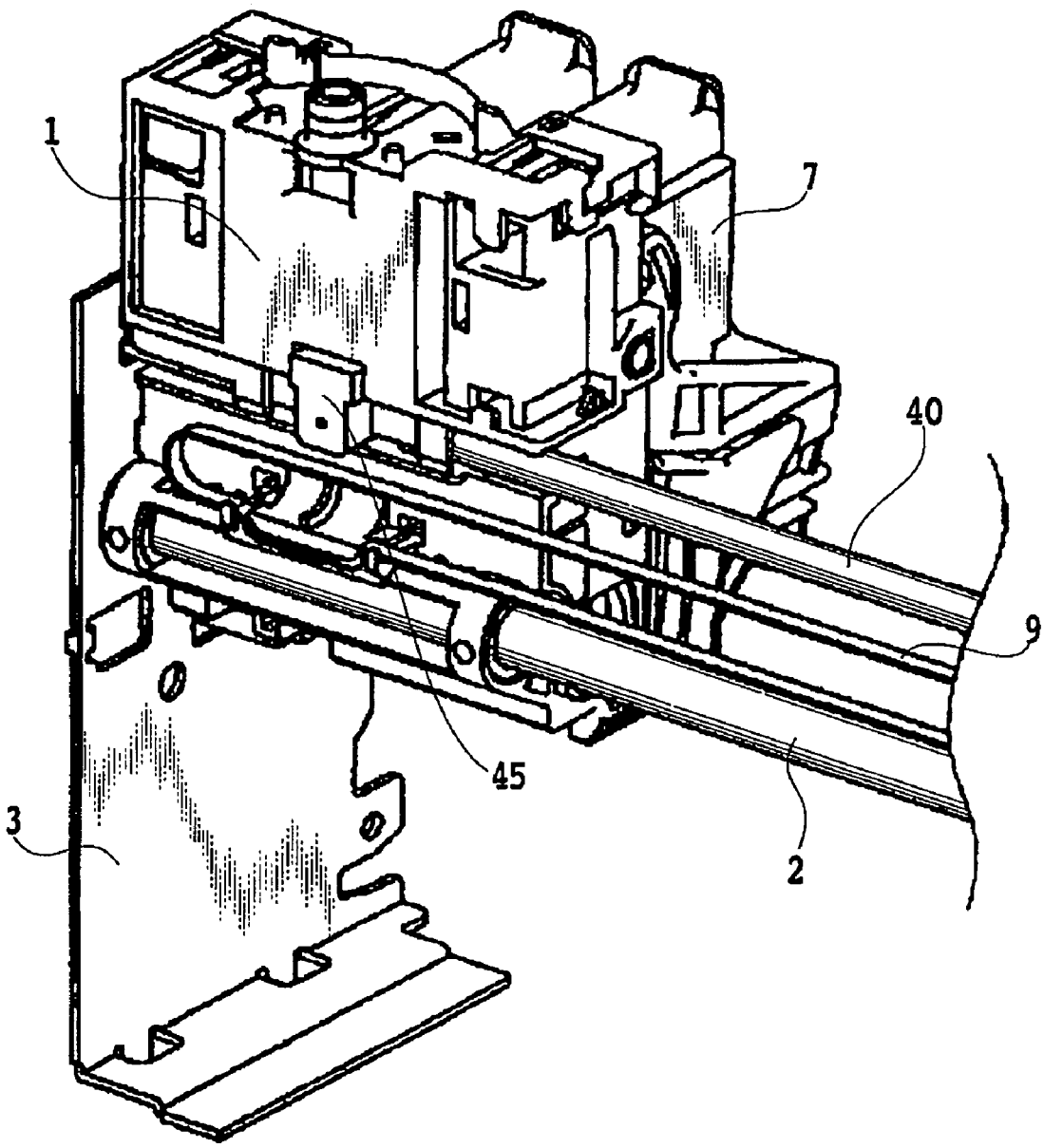
FIG. 2 is a perspective view illustrating a driving mechanism of a carrier in FIG. 1.

FIG. 1 is a perspective view illustrating an appearance of a serial type ink jet printing apparatus to which the present invention can be applied. A cover is detached from this printing apparatus. FIG. 2 is an enlarged perspective view illustrating the driving mechanism of a carrier in FIG. 1 seen from an opposite side of FIG. 1.

A carrier 1 is guided by a guide shaft 2 and a guide rail (not shown) in the main scanning direction of an arrow X so that the carrier 1 can be reciprocated. The carrier 1 is reciprocated at a position opposed to an LF roller 5 retained by a chassis 3 and a platen (not shown). A printing head 7 is mounted on the carrier 1. The carrier 1 is reciprocated in the main scanning direction along the guide shaft 2 by a driving force of a carrier motor 9 transmitted via a belt 9.

When an image is printed, the carrier 1 is accelerated from a stopped state and is moved in the main scanning direction with a fixed speed. During this movement, the printing head 7 is driven based on printing data sent to the interior of the printing apparatus to eject ink from ejecting openings of the printing head 7 to a printing medium. Then, after the first printing/scanning of the printing head 7, the carrier 1 is decelerated and is stopped and the printing medium is transported in the sub scanning direction of the arrow Y, by the LF roller 5, by a printing width by one printing/scanning. The printing/scanning of the printing head 7 and the transportation of the printing medium as described above are alternately repeated to perform a printing of one printing medium.

At a home position of the carrier 1, a pump base 30 for the maintenance of the printing head 7 is provided. When a printing operation is not performed for a long time as in the case where a power source of a printing apparatus is OFF, the carrier 1 is returned to the position of the pump base 30 and an ejecting opening face (face at which the ejecting openings are formed) of the printing head 7 is covered by a cap (not shown). This prevents moisture in ink in the ejecting opening of the printing head 7 from evaporating. Furthermore, the printing head 7 can be cleaned or a recovery operation to forcedly suck ink from the ejecting opening can be performed as required to maintain the ejecting performance of the printing head 7.

The guide shaft 2 is fixed to the chassis 3 as shown in FIG. 2 to function as a guide for the reciprocation of the carrier 1. The belt 9 wounded in the left-and-right direction is connected to the carrier motor 8 provided at the chassis 3 and is connected to the carrier 1 and converts the rotation of the carrier motor 8 to a reciprocating movement to move the carrier 1 in the main scanning direction. An encoder scale 40 extending in the left-and-right direction is retained by the chassis 3 with a predetermined tension and has a plurality of marks arranged in the longitudinal direction with a fixed pitch. The encoder scale 140 is attached with marks with 300 LPI (LinePer Inch) (i.e., 25.4 mm/300=84.6 μm) for example. The marks can be detected by an encoder sensor 45 moving together with the carrier 1 to accurately detect the position to which the carrier 1 is moved. An encoder method may be the optical or magnetic one. When the carrier 1 is moved, a time interval of the continuous detection of the marks of the linear encoder scale 40 can be used to calculate a speed at which the carrier 1 is moved.

Figure 3:
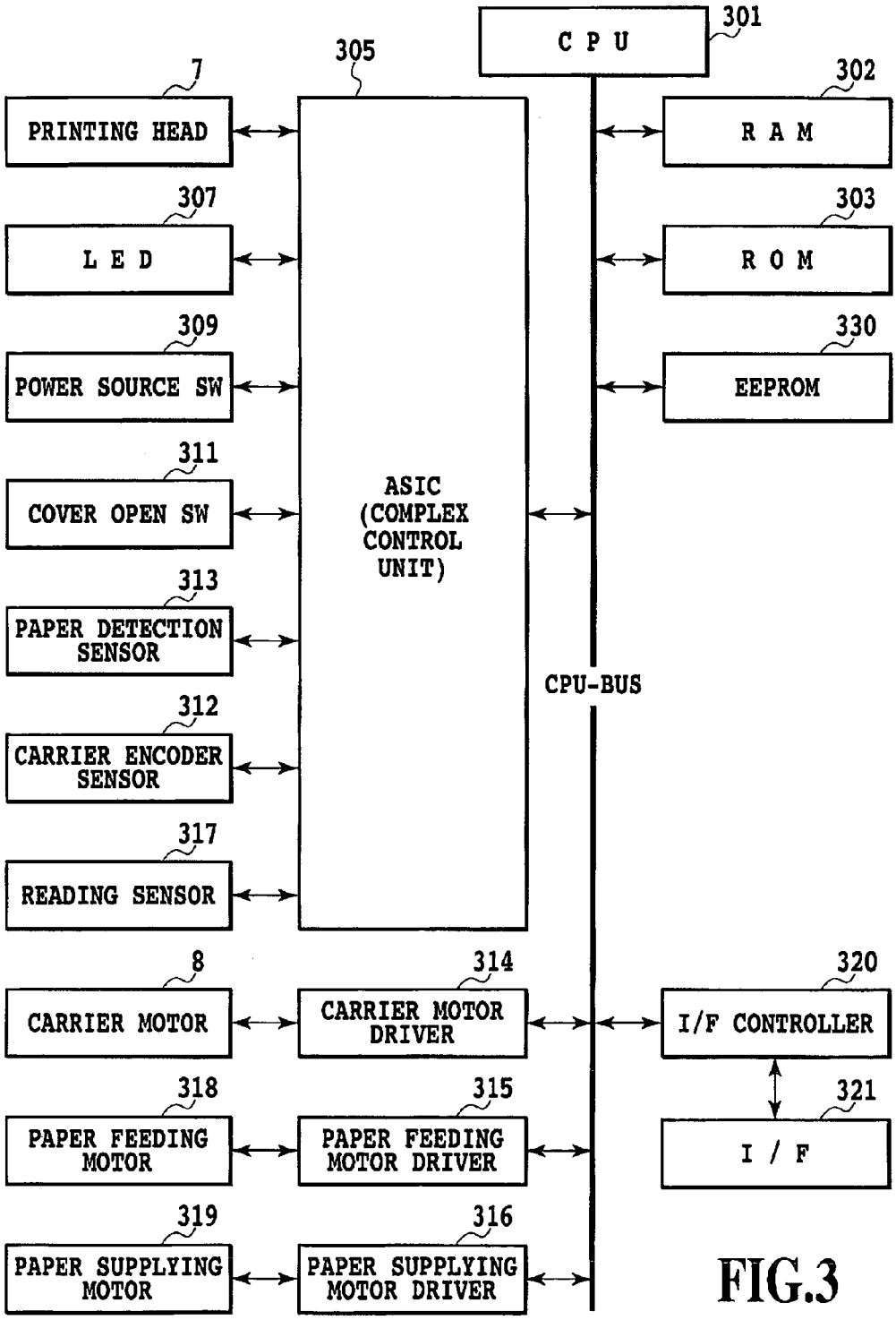
FIG. 3 is a block diagram illustrating a control system in the ink jet printing apparatus of FIG. 1.

FIG. 3 is a block diagram illustrating a control system of the ink jet printing apparatus of FIG. 1 and FIG. 2.

In FIG. 3, the reference numeral 301 denotes a CPU (central processing unit) that controls the entirety of the printing apparatus based on a control program in a ROM 303. Two sensors (carrier encoder sensor 312 and paper detection sensor 313) and various switches provided in an operation panel (e.g., power source SW309, cover open SW311) input various instruction signals via a complex control unit (ASIC) 305. A printing command sent from a host machine to an interface 321 is read by an I/F controller 320. Three motors (carrier motor 8, paper feed motor 318, and paper feed motor 319) are rotation-controlled via the motor drivers 314 to 316 and printing data is transferred via the complex control unit 305 to the printing head (ink jet printing head) 7. The CPU 301 controls, based on a program in the ROM 303, the motors 8, 318, and 319 and the printing head 7 based on various instruction signals and printing commands.

The reference numeral 317 denotes a reading sensor that can read a test pattern printed on the printing medium (which will be described later). The reading sensor 317 functions as a detection means for detecting an amount of a displacement of an ink adherence position as described later. The reading sensor 317 is mounted on the carrier 1 for example and is moved together with the carrier 1 to optically read an image on the printing medium. A detection means for detecting an amount of a displacement of an ink adherence position based on the printing result of a test pattern (which will be described later) is not limited to the reading sensor 317 attached to the printing apparatus as described above. Thus, another reading apparatus separately provided from the printing apparatus also can be used. In the first embodiment, the reading sensor 317 has a reading resolution of 600 dpi. The CPU 301 causes a printing of a test pattern as described later to perform, based on the printing result, a processing for correcting an amount of a displacement of an ink adherence position.

The reference numeral 302 denotes a RAM (temporary storage memory). This RAM 302 is used as a reception buffer for temporarily storing development data for printing and data received from the host machine (printing command, printing data), a work memory for storing required information (e.g., printing rate), and a work area of the CPU 301 for example. The reference numeral 303 denotes a ROM (read-only memory). This ROM 303 stores a printing control program for transferring the printing data implemented by the CPU 301 to the printing head 7 so that the data is printed by the printing head 7, a program for controlling the carrier 1 and a paper feed operation, a printer emulation program, and a printing font for example.

The reference numeral 305 denotes a complex control unit (ASIC) that has functions such as the control of the printing head 7, the control of a power source LED 307 (lighting, extinction, or blink operation), and the detection of a power source SW 309 or a cover open SW 311, and the detection of a paper insertion sensor 313. The reference numerals 314 to 316 denote a motor driver for controlling the driving of the respective motors 8, 318, and 319. The respective motors 8, 318, and 319 are drive-controlled by the motor drivers 314 to 316 under the control by the CPU 301.

The carrier motor 317 may be a DC servomotor for providing a servo control as described later. The paper feeding motor 318 and the paper supplying motor 319 may be a stepping motor that can be easily controlled by the CPU 301. The reference numeral 320 denotes an I/F that is connected to the host machine (e.g., computer) via the I/F 321. This I/F controller 320 is an interactive interface that receives a printing command and printing data from the host machine and that transmits error information of a printing apparatus for example. The interface may be various interfaces such as the Centro interface or the USB interface.

The reference numeral 330 denotes a nonvolatile demand writing memory EEPROM. This EEPROM 330 memorizes a registration adjustment value (adjustment value of printing position), the number of printing media to be printed, the number of ejecting ink droplets for printing (the number of formed dots), the number of exchanges of an ink tank, the number of exchanges of a printing head, or the number of executions of a cleaning operations by an instruction from a user for example. The contents written to the EEPROM 330 are retained even when the power source is turned off.

Figure 4C:
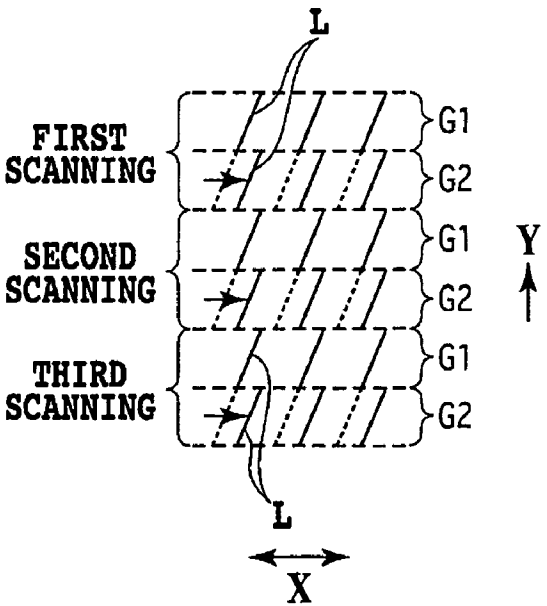
FIG. 4C illustrates a printing result when printing timings are shifted in the case of FIG. 4B.
Figure 4B:
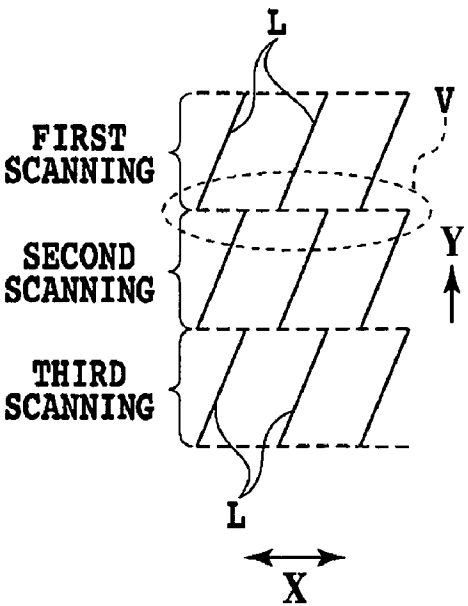
FIG. 4B illustrates a case where ruled line patterns are printed by the first, second, and third scannings by a printing head having an inclination.
Figure 4A:
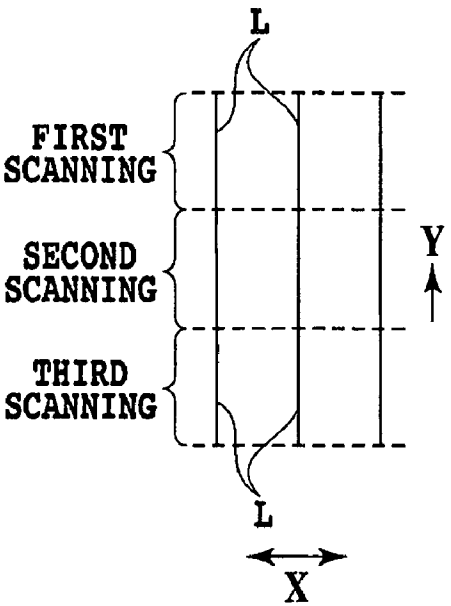
FIG. 4A illustrates a case where ruled line patterns are printed by the first, second, and third scannings by a printing head having no inclination.

FIGS. 4A, 4B, and 4C are schematic views illustrating ruled line patterns printed by the first, second, and third scannings by a printing head. The printing head is structured so that 192 nozzles are arranged in the sub scanning direction of the arrow Y with an interval of 600 dpi. Ruled line patterns in the respective printing regions of the respective first, second, and third scannings are printed by one scanning by the printing head (one pass printing). A printing resolution in the main scanning direction of the arrow X is 1200 dpi. The lines L of the ruled line patterns are printed by dots respectively formed in one line in the sub scanning direction and are formed with an interval of 7 dots in the main scanning direction.

FIG. 4A illustrates a printing result when the printing head has an inclination of zero. In this case, the lines L printed by the respective first, second, and third scannings are connected without being displaced and can be visually recognized as a straight line continuing in the sub scanning direction. FIG. 4B illustrates a printing result when the printing head has an inclination. In this case, the lines L printed by the respective first, second, and third scannings are displaced and cannot be visually recognized as a straight line.

Figure 5:
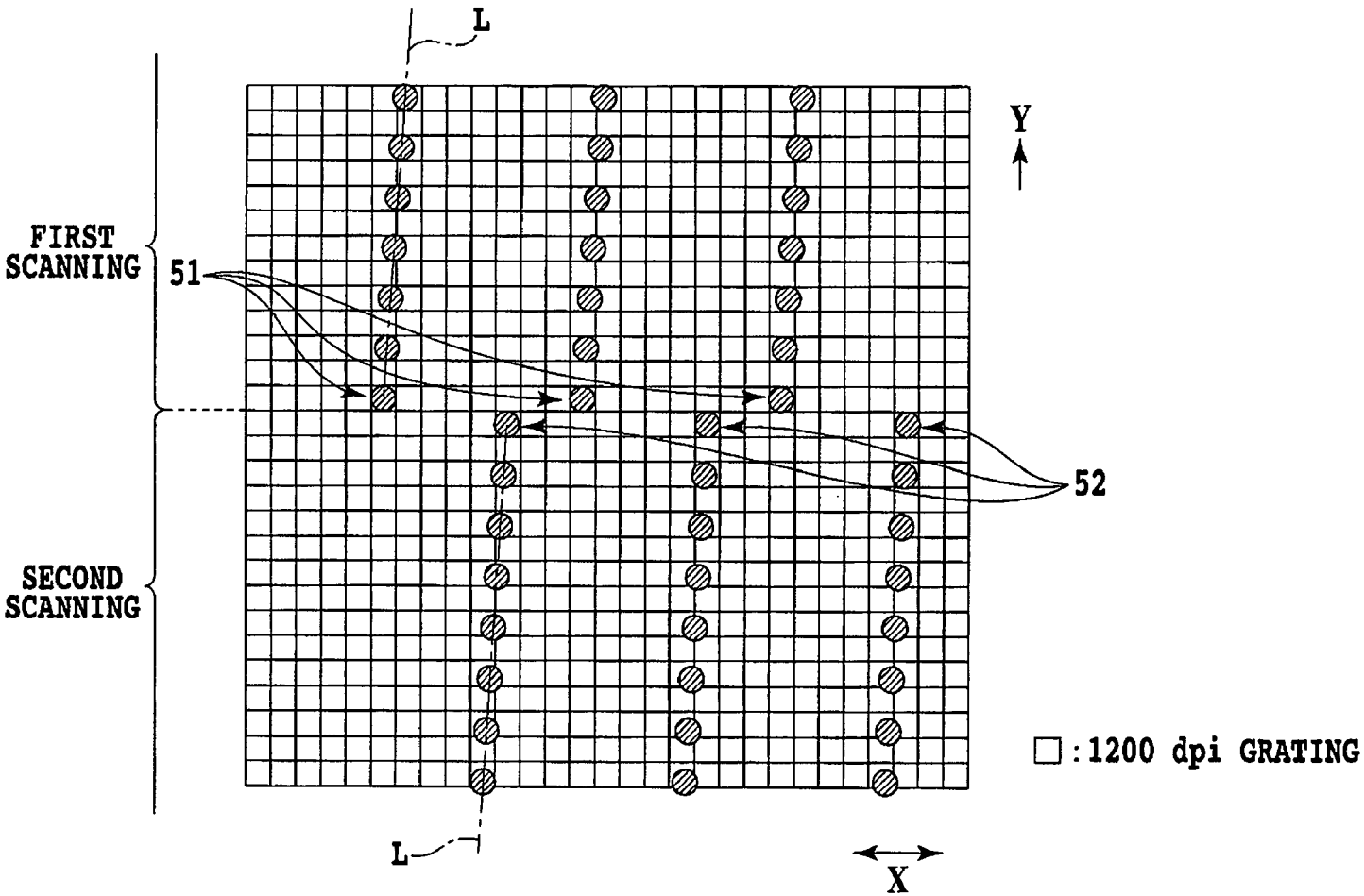
FIG. 5 is an enlarged view illustrating a circled section V in FIG. 4B.

FIG. 5 is an enlarged view illustrating the circled section V of FIG. 4B. In FIG. 5, the reference numeral 51 denotes the lowest end ink dot at the line L formed by the first scanning. The lowest end ink dot 51 is formed by ink ejected from a nozzle positioned at the lowest end of the nozzle row of the printing head (hereinafter also may be referred to as "the lowest end nozzle"). In the case of this example, the lowest end nozzle is nozzle that is positioned at the lowest end among 192 nozzles arranged in the sub scanning direction with an interval of 600 dpi. The reference numeral 52 denotes the highest end ink dot of the line L formed by the second scanning. The highest end ink dot 52 is formed by ink ejected from a nozzle positioned at the highest end of the nozzle row of the printing head (hereinafter also may be referred to as "the highest end nozzle"). In the case of this example, the highest end nozzle is nozzle that is positioned at the highest end among 192 nozzles arranged in the sub scanning direction with an interval of 600 dpi. In the case of FIG. 5, the dots 51 and 52 that should be identically arranged in the main scanning direction are displaced by 5 dots in the main scanning direction on the basis of 1200 dpi.

The displacement of a dot formation position caused by the inclination of the printing head as described above (i.e., displacement of the position at which an ink droplet is adhered (hereinafter also may be referred to as "displacement of an ink adherence position") not only has an influence on the printing of a ruled line pattern but also has a risk as described below. For example, when a pattern is printed by a plurality of scannings within a predetermined printing area (multi pass printing), the pattern may be composed of an image having increased roughness or noise, which causes an image deterioration.

(1-2) Example of Comparison of Methods for Correcting the Displacement of an Ink Adherence Position As described above, a conventional known method for detecting a displacement amount is that a user recognizes the displacement amount of the ink dots 51 and 52 based on the printing result of ruled line patterns to input the displacement amount or that a dot sensor for example is used to automatically detect the displacement amount of the ink dots 51 and 52. One method for correcting the displacement of an ink adherence position based on the detected displacement amount is that a nozzle row is divided to a plurality of nozzle groups in the sub scanning direction as described above so that, with regards to the respective divided nozzle groups, a timing at which a driving pulse is applied to the nozzle groups is shifted to change the printing timing. Another method is to shift, with regards to the respective nozzle groups, printing data assigned to the nozzle groups on the basis of a dot.

FIG. 4C illustrates a case where 192 nozzles are divided to the upper end nozzle group G1 at the upper side and the lower end nozzle group G2 at the lower end to shift the printing timing of the lower end nozzle group G2 so that ink droplets from the lower end nozzle group G2 are adhered at a position shifted by 5 dots in the main scanning direction. The control as described above allows the line L to be visually recognized almost as a straight line when compared with a case with FIG. 4B.

When the method for detecting the displacement amount based on the positional relation between the dots 51 and 52 as described above is used and when ink for forming the dots 51 and 52 is simultaneously ejected, the positional relation between the dots 51 and 52 significantly reflects an inclination of the printing head (i.e., an inclination of the nozzle row). However, there may be a case where ink for forming the dots 51 and 52 is not simultaneously ejected from the lower end nozzle and the upper end nozzle. This case is caused, for example, when ink is simultaneously ejected from a reduced number of nozzles or when the distributed driving method is used in which a plurality of nozzles are driven with different driving timings in order to suppress an interference among the nozzles during the ink ejection. When ink for forming the dots 51 and 52 is not simultaneously ejected as described above, the amount of the displacement of an ink adherence position cannot be accurately detected only based on the positional relation between the dots 51 and 52.

Furthermore, the highest end nozzle and the lowest end nozzle tend to be influenced, when compared with other nozzles, by water evaporation in ink maintained in a printing head. This causes a risk where, in the case where nozzles eject ink with a long ink ejecting interval in particular, ink droplets are ejected from these nozzles in a shifted direction (ink ejecting deviation). Furthermore, when a plurality of nozzles collectively eject ink, air current caused by the ejection may shift a direction along which ink droplets are ejected from the highest end nozzle and the lowest end nozzle.

As described above, it has been difficult to accurately detect an amount of the displacement of an ink adherence position only based on the positional relation between the dots 51 and 52. There also has been a limitation on the correction of the displacement of an ink adherence position based on the detection result.

Next, a first embodiment of a method for correcting the displacement of an ink adherence position will be described. In the first embodiment, a means for detecting an amount of a displacement of an ink adherence position has a detection resolution that is half of the printing resolution in the main scanning direction of the printing head.

(1-3) Test Pattern

First, a test pattern that is printed in order to detect a displacement of an ink adherence position will be described.

Figure 6A:
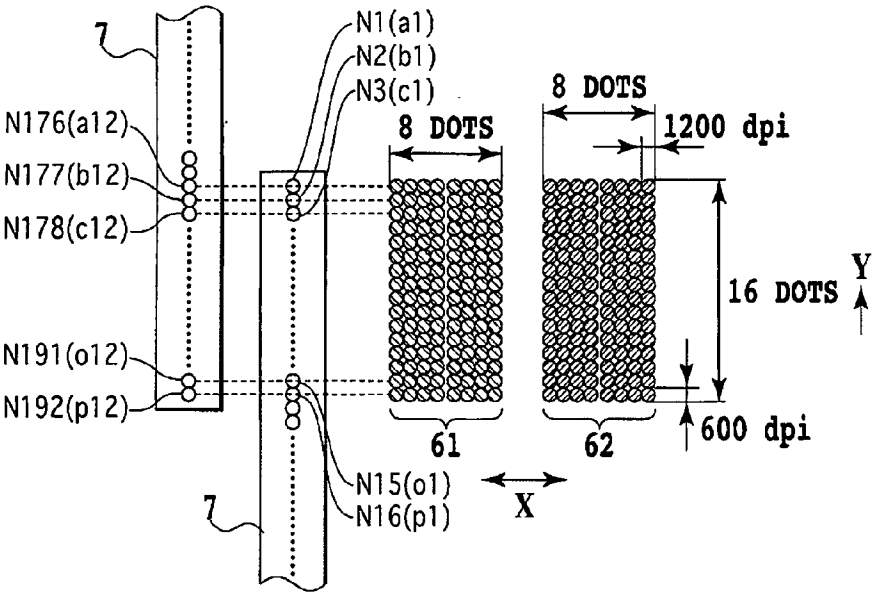
FIG. 6A illustrates a relation between a test pattern and nozzles in the first embodiment of the present invention.

FIG. 6A illustrates a test pattern printed by two scannings by the printing head 7. The printing head 7 of this example is structured so that 192 nozzles are arranged with an interval of 600 dpi in the sub scanning direction of the arrow Y. In FIG. 6A, 192 nozzles of the printing head 7 ranging from the highest end nozzle to the lowest end nozzle are denoted with the reference numerals N1 to N192. A test pattern is printed by 16 nozzles from the highest end nozzle N1 to the nozzle N16 (hereinafter also may be referred to as "the highest end nozzle group") and 16 nozzles from the lowest end nozzle 192 to the nozzle 176 (hereinafter also may be referred to as "the lowest end nozzle group"). The printing head 7 in FIG. 6A is represented as moving in an opposite direction relative to a direction shown by the arrow Y along which a printing medium is transported (sub scanning direction). The printing head 7 has a printing resolution of 1200 dpi in the main scanning direction under conditions of a carrier traveling speed of 25 inch/second and a driving frequency of 15 khz.

The means for detecting an amount of a displacement of an ink adherence position in this example can detect an amount of a displacement of an ink adherence position in the main scanning direction on the basis of 600 dpi.

Figure 6B:
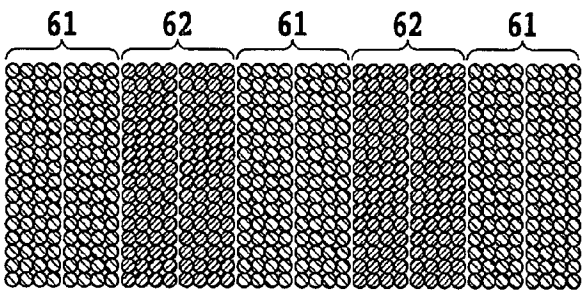
FIG. 6B, FIG. 6C, and FIG. 6D illustrate different printing results of test patterns corresponding to inclinations of printing heads, respectively.

A test pattern is printed by two scannings in the manner as described below. First, ink is ejected from the lower end nozzle group (nozzles 176 to 192) to form dots 61 constituting the test pattern. Thereafter, the printing head 7 is moved in an opposite direction of the arrow Y relative to a printing medium and then ink is ejected from the highest end nozzle group (nozzles 1 to 16) to form dots 62 for forming the test pattern. FIG. 6B illustrates a printing result of the test pattern when the printing head 7 has no inclination.

Next, the reason why the test pattern as described above is used will be described.

Figure 7A:
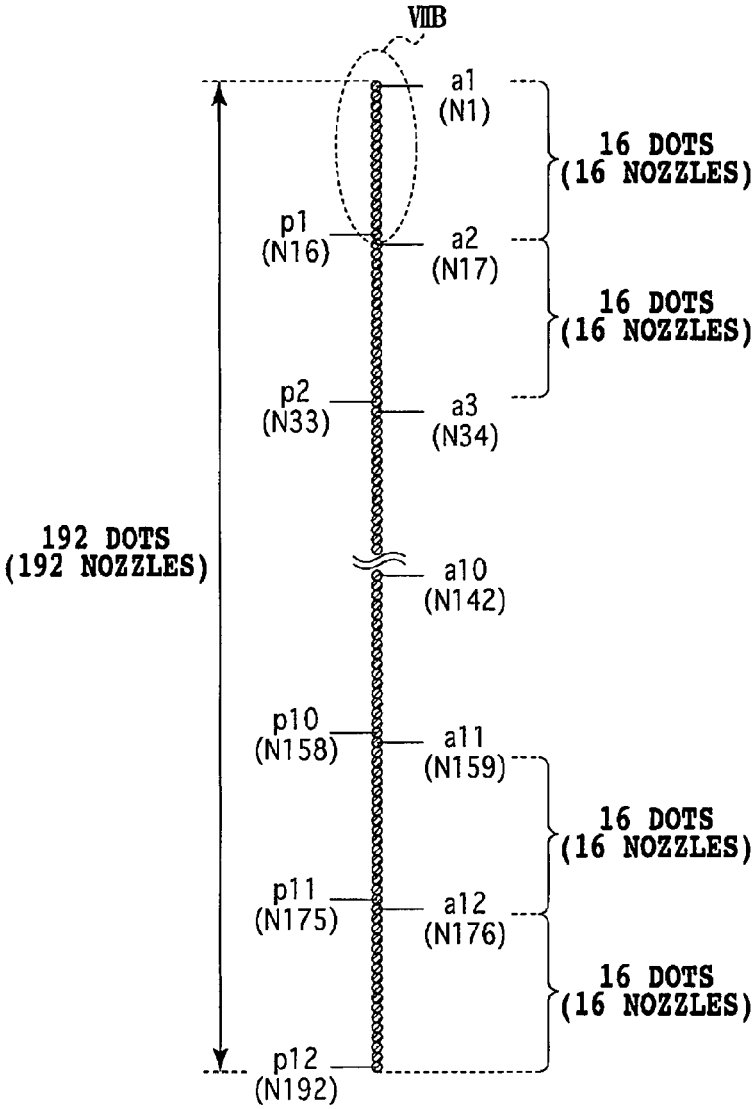
FIG. 7A is a schematic view illustrating a distributed driving of nozzles in a printing head.
Figure 7B:
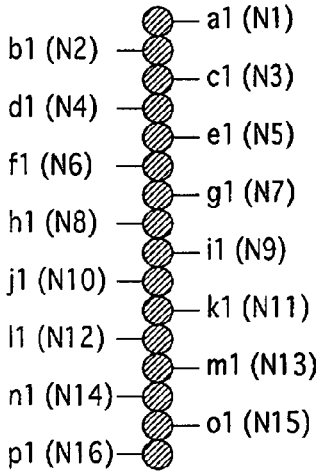
FIG. 7B is an enlarged view illustrating a circled section VIIB of FIG. 7A.

The printing head 7 for printing the test pattern is structured so that 192 nozzles are divided by 12 to provide 16 nozzle groups in order to reduce the mutual interference of ink ejected from neighboring nozzles. These 16 nozzle groups are driven in a distributed manner so that the driving timings are shifted to one another. For example, when a ruled line pattern as shown in FIG. 7A is printed that have a printing resolution of 600 dpi in the sub scanning direction by one scanning using all 192 nozzles, dots a1, a2, a3, . . . a12 are simultaneously formed. Specifically, nozzles N1, N17, N37, . . . N176 divided on the basis of 16 nozzles as an interval eject ink simultaneously. Similarly, dotsb (b1, b2, b3, . . . b12), dots c (c1, c2, c3, . . . c12), . . . and dots p (p1, p2, p3, . . . p12) are also simultaneously formed (see FIG. 7B). Timings at which the dots a, b, c, . . . p are formed are shifted to one another.

The printing head 7 has an inclination that is accurately reflected, for example, on a relational position in the main scanning direction between the dot a1 formed by the highest end nozzle N1 and the dot a12 that is formed simultaneously with the formation of the dot a1 and that is farthest from the dot a1.

In this example, in order to allow a user to visually recognize a test pattern more easily, the upper end nozzle group (nozzles 1 to 16) and the lower end nozzle group (nozzles 176 to 192) are used. The carrier is moved with a traveling speed of 25 inch/second and the printing head 7 is driven with a driving frequency of 7.5 khz, thereby printing a test pattern as shown in FIG. 6B. Specifically, the lower end nozzle group firstly forms the dots 61 in the main scanning direction with a printing resolution of 600 dpi as a plurality of groups each of which is based on 8 dots arranged in the main scanning direction with an interval of 8 dots. Thereafter, another printing/scanning is performed in which the upper end nozzle group forms the dots 62 in the main scanning direction with a printing resolution of 600 dpi as a plurality of groups each of which is based on 8 dots arranged in the main scanning direction with an interval of 8 dots. In FIG. 6B, the dots 61 and 62 neighboring to each other in the main scanning direction are formed by simultaneously ejected ink and are formed by nozzles that are away from each other with a distance therebetween identical with a distance between the nozzle N1 and the nozzle N176 (nozzles for forming the dots a1 and a12).

Figure 6C:
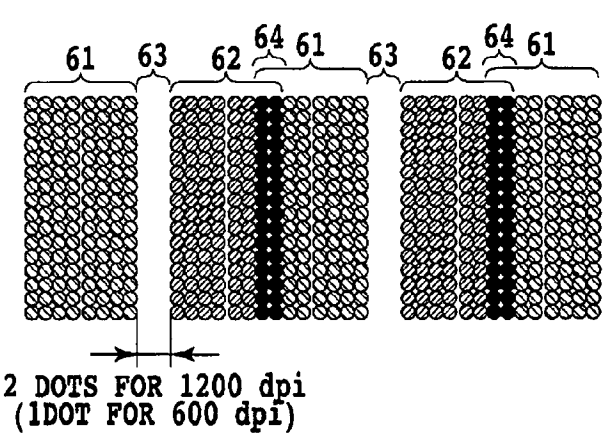
Figure 6D:
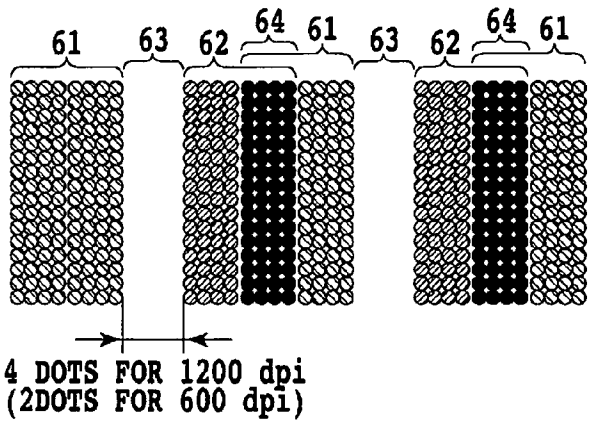

When the test pattern is printed by the uniform dot arrangement as shown in FIG. 6B, the printing head 7 has no inclination. On the other hand, when a region 64 in which dots are superposed and a region 63 in which dots are not provided to cause a white appearance appear as shown in FIG. 6C and FIG. 6D, the level at which they appear can be used to detect an amount of the displacement of an ink adherence position caused by the inclination of the printing head 7. FIG. 6C illustrates a printing example where the displacement of an ink adherence position of two dots is caused in the main scanning direction by the inclination of the printing head 7. As shown in FIG. 6C, the region 63 in which dots are not provided and the region 64 where dots are superposed to have a density higher than those of the other regions can be visually recognized. FIG. 6D illustrates a printing result of a case where an inclination of the printing head 7 causes the displacement of an ink adherence position of 4 dots in the main scanning direction.

FIG. 8 illustrates the comparison of three test patterns. The first test pattern is a pattern for comparing a position of one dot formed by the highest end nozzle with a position of one dot formed by the lowest end nozzle. The second test pattern is a pattern for comparing a position of one dot formed by the highest end nozzle with a position of one dot formed by the lowest end nozzle that is formed simultaneously with the highest end nozzle and that is formed by a nozzle farthest from the highest end nozzle. The third test pattern is a pattern for comparing positions of a plurality of dots formed by the upper end nozzle group with positions of a plurality of dots formed by the lower end nozzle group as shown in FIG. 6B as described above.

These three test patterns were evaluated with regards to inclination amounts of printing heads estimated based on the respective printing results and actual inclination amounts of the printing heads and the consistency therebetween as well as visual appearances of the patterns.

The evaluation shows that the first test pattern shows no consistency between an inclination amount of the printing head estimated based on the printing result and an actual inclination amount of the printing head. The reason is that the nozzles are driven in a distributed manner and thus the highest end nozzle and the lowest end nozzle do not simultaneously eject ink. The evaluation shows that the second test pattern shows a consistency between an inclination amount of the printing head estimated based on the printing result and an actual inclination amount of the printing head. However, the second test pattern has a deteriorated visual appearance due to the comparison between single dots, causing a risk where a dot displacement amount may be detected in a wrong manner. The evaluation shows that the third test pattern can improve a visual appearance that is a disadvantage of the second test pattern.

As described above, by the use of the test patterns according to this example, a user can visually detect an amount of a displacement of an ink adherence position in the main scanning direction even with a resolution (600 dpi) that is about half of the printing resolution in the main scanning direction (1200 dpi). Thus, the user can easily recognize such an amount of a displacement of an ink adherence position. Thus, the reading sensor 317 (see FIG. 3) is not always required in order to detect an amount of a displacement of an ink adherence position.

A test pattern also may be a pattern formed by nozzles other than the highest end nozzle N1 and the lowest end nozzle N192. The reason is that these nozzles N1 and N192 tend to cause deviation that causes shifted ink ejection due to water evaporation of ink in the printing head and that ink collectively ejected from a plurality of nozzles causes air current that tends to cause a displaced ink adhesion position. A test pattern that does not use these nozzles N1 and N192 can detect, as in the case of the above-described test patterns, an amount of a displaced ink adherence position caused by the inclination of a printing head. A test pattern in this case is a pattern in which 14 dots are arranged in the sub scanning direction with a printing resolution of 600 dpi.

A means for detecting an amount of a displaced ink adherence position based on the printing result of the test pattern as described above may be, for example, a reading sensor (optical sensor) 317 having a resolution that is half of a dot printing resolution in the main scanning direction. The dot printing resolution in the main scanning direction in the case of this example is 1200 dpi and thus the detection means may have a reading resolution of 600 dpi.

(1-4) Method for Correcting Printing Position

Next, the following section will describe a method for correcting, after the detection of the inclination in the main scanning direction of the printing head, a printing position based on the printing result of the test pattern as described above.

In the case of this example, the printing head has a printing resolution in the main scanning direction of 1200 dpi under conditions of a carrier traveling speed of 25 inch/second and a driving frequency of 15 khz.

Figure 9A:
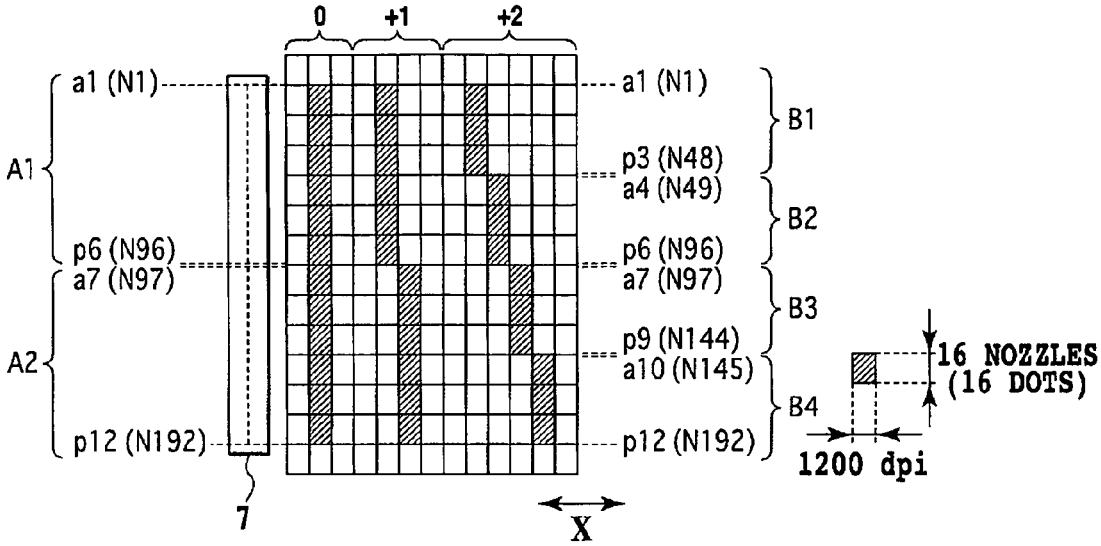
FIG. 9A illustrates control modes in the first embodiment of the present invention.
Figure 9B:
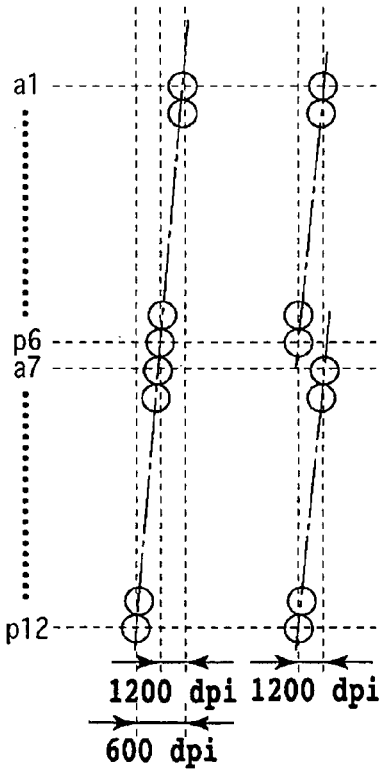
FIG. 9B illustrates the printing result when the control mode in FIG. 9A is "+1"

When the printing result of the test pattern is the one as shown in FIG. 6C, a detection means having a reading resolution of 600 dpi detects the displacement of an ink adherence position of one dot for 600 dpi (displacement of an ink adherence position of two dots for 1200 dpi). In this case, 192 nozzles arranged in the sub scanning direction are divided, as shown in the case of "+1" in FIG. 9A, to two nozzle groups A1 and A2. Then, the nozzle group A1 including the nozzle N1 is used as a reference nozzle group and a driving timing of the nozzle group A2 is shifted, to the reference nozzle group A1, by one dot with a printing resolution of 1200 dpi. As a result, the displacement amount of one dot for 600 dpi caused in the entire nozzle row (192 nozzles) as shown in the left side in FIG. 9B is corrected to a half displacement amount of one dot for 1200 dpi as shown by the right side of FIG. 9B.

Figure 9C:
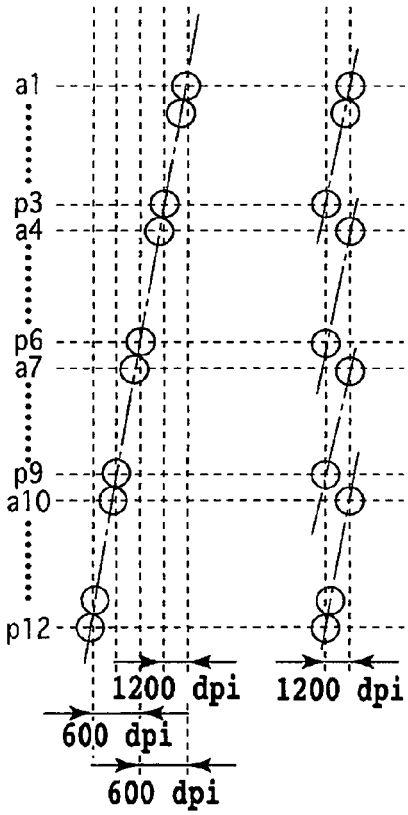
FIG. 9C illustrates the printing result when the control mode in FIG. 9A is "+2"

When the printing result of the test pattern is the one as shown in FIG. 6D, a detection means having a reading resolution of 600 dpi detects the displacement of an ink adherence position of two dots for 600 dpi (displacement of an ink adherence position of four dots for 1200 dpi). In this case, 192 nozzles are divided, as shown in the case of "+2" in FIG. 9A, to four nozzle groups B1 to B4. Then, the nozzle group B1 including the nozzle N1 is used as a reference nozzle group and driving timings of the nozzle groups B2, B3, and B4 are shifted. Specifically, a driving timing of the nozzle group B2 is shifted to the reference nozzle group B1 by one dot for 1200 dpi and the driving timing of the nozzle group B3 is shifted by two dots for 1200 dpi and the driving timing of the nozzle group B4 is shifted by three dots for 1200 dpi. As a result, the displacement amount of two dots for 600 dpi caused in the nozzle row (192 nozzles) as in the left side of FIG. 9C is corrected to a displacement amount of one dot for 1200 dpi which is a quarter of it as shown in the right side of the drawing.

As described above, the test pattern of this example is printed with a resolution (1200 dpi) that is two times higher than a reading resolution of a detection means in the main scanning direction (600 dpi). When the displacement amount of an ink adherence position in the main scanning direction in the test patter as described above is assumed as N (i.e., when the displacement amount of N dots for 600 dpi detected by the detection means is assumed as a displacement amount N), then a nozzle row is divided as described above. Specifically, the total number of nozzles arranged in a printing head is divided to groups (N ×2) and a nozzle group including an highest end nozzle is assumed as a reference nozzle group. Then, a driving timing (which is used when a printing head forms dots in the main scanning direction) of a nozzle group is shifted by one dot in an order of nozzle groups closer to the reference nozzle group. Thus, displacement of an ink adhesion position is corrected. As described above, the displacement of an ink adherence position in the main scanning direction due to an inclination of a printing head can be reduced to a width of one dot of the printing resolution in the driving frequency of the printing head.

The correction of the displacement of an ink adherence position as described above also can be performed by shifting the printing data allocated to the respective divided nozzle groups. Specifically, printing data allocated to nozzle groups are shifted, by one dot, in an order of nozzle groups closer to the reference nozzle group based on the driving frequency used when the printing head forms dots in the main scanning direction. As a result, the displacement of an ink adherence position due to the inclination of the printing head can be corrected to a width of a dot based on the driving frequency of the printing head.

In this example, the driving block consists of 16 nozzles and thus the number of nozzles constituting the divided nozzle groups is a integral multiple of 16. Specifically, the number of nozzles constituting the divided nozzle groups is a multiple of the number of nozzles constituting a driving block (16 blocks from "a" to "p"). This is advantageous for avoiding a complicated circuit configuration for the control of the correction of the displacement of an ink adherence position and for avoiding a complicated control of the driving of the printing head.

Furthermore, a multi pass printing also can divide a nozzle row to a plurality of nozzle groups when the control for correcting the displacement of an ink adherence position caused by the inclination of a printing head is performed. Specifically, the number of nozzles constituting divided nozzle groups can be a multiple of the number of nozzles (16 nozzles) constituting driving blocks (16 blocks from "a" to "p"). In this case, a transportation amount (paper feed amount) of a printing medium in the multi pass printing is desirably a multiple of the length of nozzles constituting the driving block. The reason is that this can reduce, when a boundary at the divided nozzle groups has a displacement having a width of one dot in the driving frequency of the printing head, a frequency at which the displacement appears.

FIG. 10 illustrates an effect by a method for correcting the displacement of an ink adherence position in this example. Such a printing head was used that was structured to have the maximum dot resolution in the main scanning direction of 1200 dpi under conditions of a carrier traveling speed of 25 inch/second and a driving frequency of the printing head of 15 khz. A test pattern was printed by the printing head as described above. As a result, a displacement of an ink adherence position of two dots for 600 dpi was caused as shown in FIG. 6A. This displacement was corrected by two different correction methods. In the first correction method, the first test pattern of FIG. 8 as described above is printed as in the above-described conventional method. The first test pattern is a pattern for comparing single dots that are for comparing, as described above, a positional relation between one dot formed by the highest end nozzle and one dot formed by the lowest end nozzle. Then, an amount of the displacement of an ink adherence position is detected based on the printing result. Based on the detection result, the number with which a nozzle row is divided is determined to correct the displacement of an ink adherence position. In the second correction method, the number at which a nozzle row is divided is determined, based on the printing result of the test pattern of FIG. 6D as in the above-described example, as a multiple of nozzles (16 nozzles) constituting a driving block (16 blocks from "a" to "p"). Thus, the displacement of an ink adherence position is corrected.

The first and second methods as described above were compared with regards to the following four items (see FIG. 10).

(i) Circuit configuration and the control of head driving (ii) Visual appearance of a ruled line pattern by one pass printing (iii)) Roughness of an image by a four pass printing (printing resolution in the main scanning direction of 1200 dpi)

(iv) Roughness of an image by a six pass printing (printing resolution in the main scanning direction of 1200 dpi)

The comparison for the above item (i) was performed based on settings on jigs and tools.

The comparison result of FIG. 10 shows that the second method of this example is effective for all of the four items of (i) to (iv).

(2) Second Embodiment

Next, a second embodiment of the present invention will be described. The second embodiment shows an example of a configuration in the case where a means for detecting the displacement of an ink adherence position has a detection resolution (reading resolution) that is identical with the printing resolution in the main scanning direction of a printing head.

As shown in FIG. 11A, the second embodiment also prints the test pattern as in FIG. 6A as described for the first embodiment. The second embodiment has the same structure of the printing head 7 and the same printing conditions as those of the first embodiment as described above. Specifically, a test pattern is printed by two scannings. First, ink is ejected from the lower end nozzle group (nozzles 176 to 192) to form the dots 61. Thereafter, the printing head 7 is moved in an opposite direction of the arrow Y relative to a printing medium and then ink is ejected from the highest end nozzle group (nozzles 1 to 16) to form the dots 62.

FIG. 11B illustrates the printing result of the test pattern when the printing head 7 has no inclination. The printing head 7 has a printing resolution in the main scanning direction of 1200 dpi and a printing resolution in the sub scanning direction of 600 dpi. In this example, a means for detecting the amount of the displacement of an ink adherence position can detect an amount of the displacement of an ink adherence position in the main scanning direction on the basis of 1200 dpi.

When dots are uniformly arranged as shown in FIG. 11B in the printing result of the test pattern, the printing head 7 has no inclination. On the other hand, in the case as shown in FIG. 11C, FIG. 11D, and FIG. 11E where the region 64 in which dots are superposed and the region 63 in which no dot is provided to have a white appearance appear, then a level at which they appear can be used to detect an amount of the displacement of an ink adherence position caused by the inclination of the printing head 7. FIG. 11C shows an example of a printing when the inclination of the printing head 7 causes the displacement of an ink adherence position of one dot in the main scanning direction. The region 63 in which dots are not provided and the region 64 where dots are superposed to have a density higher than those of the other regions can be visually recognized. FIG. 11D and FIG. 11E illustrate an example of a printing where the inclination of the printing head 7 causes the displacement of an ink adherence position of two dots and three dots in the main scanning direction, respectively.

The means for detecting the displacement of an ink adherence position based on the printing result of the test pattern as described above also may be, for example, an optical sensor having the same resolution as the dot printing resolution in the main scanning direction. The dot printing resolution in the main scanning direction in this example is 1200 dpi and thus the detection means may have a reading resolution of 1200 dpi.

(2-1) Method for Correcting a Printing Position

In the case of this example, the printing head has a printing resolution in the main scanning direction of 1200 dpi under conditions of a carrier traveling speed of 25 inch/second and a driving frequency of 15 khz.

Figure 12A:
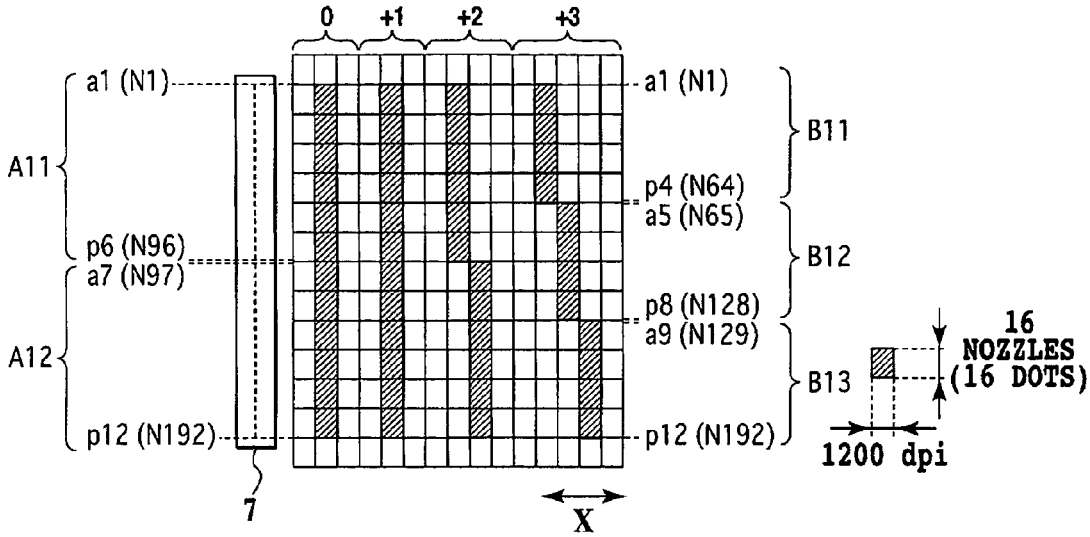
FIG. 12A illustrates control modes in the second embodiment of the present invention.
Figure 12B:
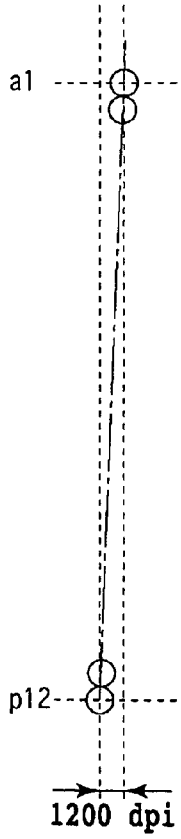
FIG. 12B illustrates the printing result when the control mode in FIG. 12A is "+1"

When the printing result of the test pattern is the one as shown in FIG. 11C, the detection means having the reading resolution of 1200 dpi detects the displacement of an ink adherence position of one dots for 1200 dpi. In this case, 192 nozzles arranged in the sub scanning direction are not divided as in "+1" of FIG. 12A and the driving timings are not corrected. The reason is that the printing resolution in the main scanning and the reading resolution of the detection means are both 1200 dpi. In other words, a displacement of one dot as in the case of the printing resolution of FIG. 12B cannot be corrected.

Figure 12C:
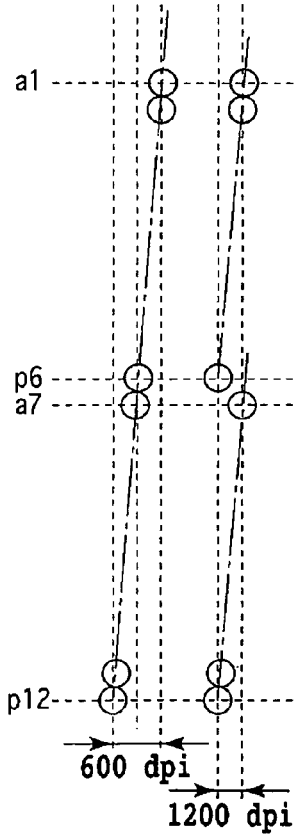
FIG. 12C illustrates the printing result when the control mode in FIG. 12A is "+2"

When the printing result of the test pattern is the one as shown in FIG. 1D, the detection means having a reading resolution of 1200 dpi detects the displacement of an ink adherence position of two dots for 1200 dpi. In this case, 192 nozzles are divided to two nozzle groups A11 and A12 as in the case of "+2" of FIG. 12A. Then, the nozzle group A11 including the nozzle N1 is used as a reference nozzle group and a driving timing of the nozzle group A12 is shifted, to the reference nozzle group A11, by one dot with a printing resolution of 1200 dpi. As a result, the displacement amount of two dots for 1200 dpi caused in the entire nozzle row (192 nozzles) as shown in the left side in FIG. 12C is corrected to a displacement amount of one dot that is half of two dots as shown in the right side of the drawing.

Figure 12D:
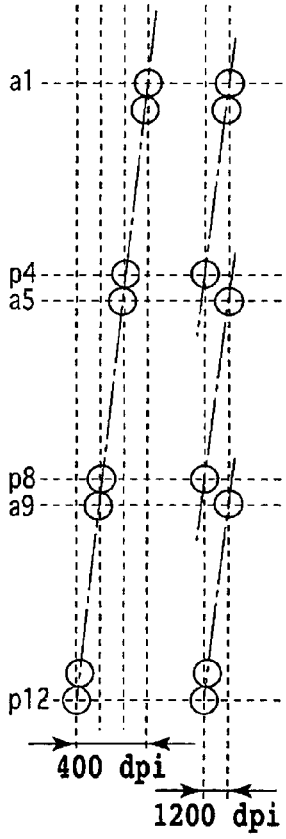
FIG. 12D illustrates the printing result when the control mode in FIG. 12A is "+3"

When the printing result of the test pattern is the one as shown in FIG. 1E, a detection means having a reading resolution of 1200 dpi detects the displacement of an ink adherence position of three dots for 1200 dpi. In this case, 192 nozzles are divided, as shown in the case of "+3" in FIG. 12A, to three nozzle groups B11 to B13. Then, the nozzle group B11 including the nozzle N1 is used as a reference nozzle group and the driving timing of the nozzle group B12 is shifted, to this reference nozzle group B11, by one dot for 1200 dpi and the driving timing of the nozzle group B13 is shifted by two dots for 1200 dpi. As a result, the displacement amount of three dots for 1200 dpi caused in the entire nozzle row (192 nozzles) as in the left side of FIG. 12D is corrected to a displacement amount of one dot which is one-third of it as shown in the right side of the drawing.

As described above, the test pattern of this example is printed with a resolution (1200 dpi) that is equal to the reading resolution of the detection means in the main scanning direction (1200 dpi). When assuming that the amount of the displacement of an ink adherence position in the main scanning direction in the test pattern as described above is M (i.e., when assuming that the displacement amount of M dots for 1200 dpi detected by the detection means is a displacement amount M), the total number of nozzles arranged in the printing head is divided to M groups as described above. Then, a nozzle group including the highest end nozzle is used as a reference nozzle group. Then, the driving timings are shifted by one dot in an order of nozzle groups closer to the reference nozzle group based on the driving frequency used when a printing head forms dots in the main scanning direction. Thus, the displacement of the ink adhesion position is corrected. As described above, the displacement of the ink adhesion position in the main scanning direction due to the inclination of the printing head can be reduced to a width of one dot of the printing resolution based on the driving frequency of the printing head.

Furthermore, the correction of the displacement of an ink adherence position as described above also can be performed by shifting the printing data allocated to the respective divided nozzle groups. Specifically, printing data allocated to nozzle groups are shifted, by one dot, in an order of nozzle groups closer to the reference nozzle group based on the driving frequency used when the printing head forms dots in the main scanning direction. As a result, the displacement of an ink adherence position due to the inclination of the printing head can be corrected to a width of a dot based on the driving frequency of the printing head.

In this example, the driving block consists of 16 nozzles and thus the number of nozzles constituting the divided nozzle groups is a integral multiple of 16. Specifically, the number of nozzles constituting the divided nozzle groups is a multiple of the number of nozzles constituting a driving block (16 blocks from "a" to "p"). This is advantageous for avoiding a complicated circuit configuration for the control of the correction of the displacement of an ink adherence position and for avoiding a complicated control of the driving of a printing head.

Furthermore, a multi pass printing also can divide a nozzle row to a plurality of nozzle groups when the control for correcting the displacement of an ink adherence position caused by the inclination of a printing head is performed. Specifically, the number of nozzles constituting divided nozzle groups can be a multiple of the number of nozzles (16 nozzles) constituting driving blocks (16 blocks from "a" to "p"). In this case, a transportation amount (paper feed amount) of a printing medium in the multi pass printing is desirably a multiple of the length of nozzles constituting the driving block. The reason is that this can reduce, when a boundary at the divided nozzle groups has a displacement having a width of one dot in the driving frequency of the printing head, a frequency at which the displacement appears.

FIG. 13 illustrates an effect of the method for correcting the displacement of an ink adherence position of this example. Such a printing head was used that is structured to have the maximum dot resolution in the main scanning direction of 1200 dpi under conditions of a carrier traveling speed of 25 inch/second and a driving frequency of the printing head of 15 khz. A test pattern was printed by the printing head as described above, As a result, a displacement of an ink adherence position of three dots for 1200 dpi was caused as shown in FIG. 11E. This displacement was corrected by two different correction methods. In the first correction method, the first test pattern of FIG. 10 as described above is printed as in the above-described conventional method. The first test pattern is a pattern for comparing single dots that is for comparing, as described above, a positional relation between one dot formed by the highest end nozzle and one dot formed by the lowest end nozzle. Then, an amount of the displacement of an ink adherence position is detected based on the printing result. Based on the detection result, the number with which a nozzle row is divided is determined to correct the displacement of an ink adherence position. In the second correction method, the number at which a nozzle row is divided is determined, based on the printing result of the test pattern of FIG. 11E as in the above-described example, as a multiple of nozzles (16 nozzles) constituting a driving block (16 blocks from "a" to "p"). Thus, the displacement of an ink adherence position is corrected.

The first and second methods as described above were compared with regards to the following four items (see FIG. 13).

(i) Circuit configuration and the control of head driving (ii) Visual appearance of a ruled line pattern by one pass printing (iii)) Roughness of an image by a four pass printing (printing resolution in the main scanning direction of 1200 dpi)

(iv) Roughness of an image by a six pass printing (printing resolution in the main scanning direction of 1200 dpi)

The comparison for the above item (i) was performed based on settings on jigs and tools.

The comparison result of FIG. 13 shows that the second method of this example is effective for all of the four items of (i) to (iv).

(3) Third Embodiment

Figure 14:
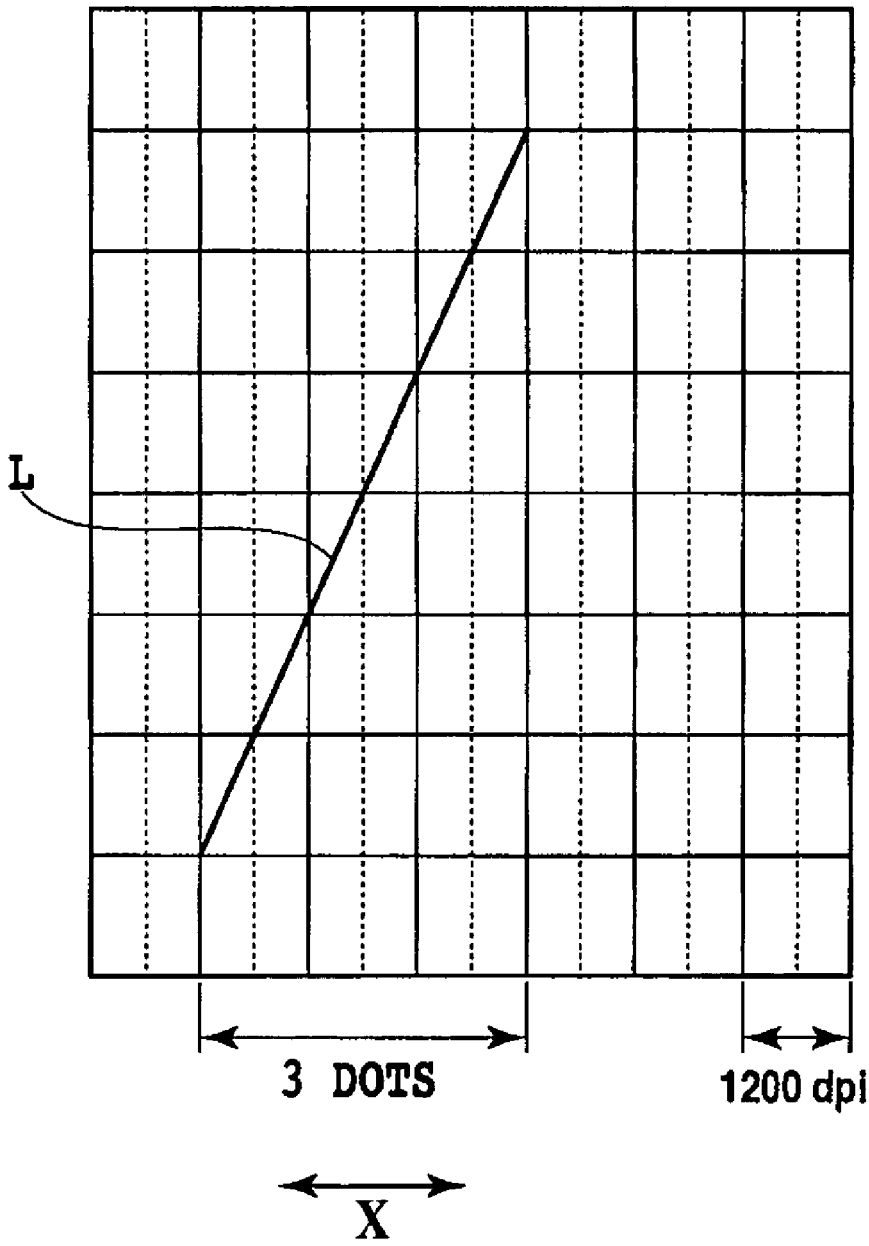
FIG. 14 illustrates the printing result of a ruled line pattern when a nozzle row is inclined by 3 dots in the main scanning direction.
Figure 15:
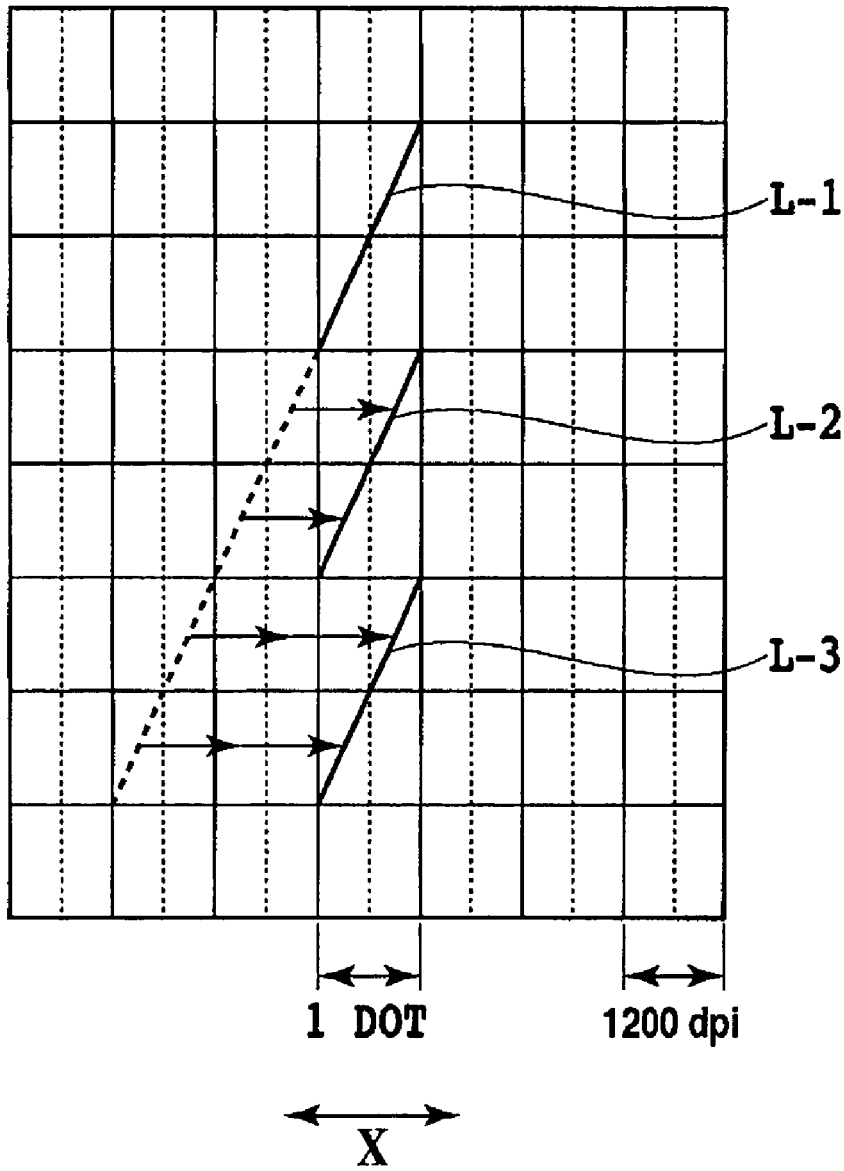
FIG. 15 illustrates the printing result when a printing timing is shifted in FIG. 14.

In the embodiments as described above, a case was assumed where an amount of the displacement of an ink adhesion position in the main scanning direction is in an amount of plural dots of the printing resolution and a method for correcting the displacement of the ink adherence position has been described. For example, when the printing resolution in the main scanning direction is 1200 dpi as in FIG. 14, a ruled line L corresponding to the inclination of the nozzle row (hereinafter also may be referred to as "nozzle row L") is a multiple of one dot of the printing resolution 1200 dpi (three dots in FIG. 14, which is three times higher than one dot). When the nozzle row L has an inclination as shown in FIG. 14, the nozzle row L is divided to three parts as shown in FIG. 15 (L-1, L-2, and L-3) to shift the driving timings of them. Thereby, the displacement amount of the ink adhesion position is corrected within a range of one dot for the printing resolution of 1200 dpi. Specifically, the above-described embodiments have corrected, when the nozzle row L is inclined with an inclination amount as a multiple of a pixel unit, the displacement amount of the ink adhesion position. However, an actual inclination amount of a nozzle row is not always a multiple of a pixel unit.

There may be a case where a performance of a printing apparatus may prevent a dot formation position from being shifted by 0.5 pixel for example. When the printing apparatus as described above has a nozzle row inclined with an inclination amount of 0.5 pixel, the correction of the displacement of the ink adhesion position will have a limitation.

Figure 16:
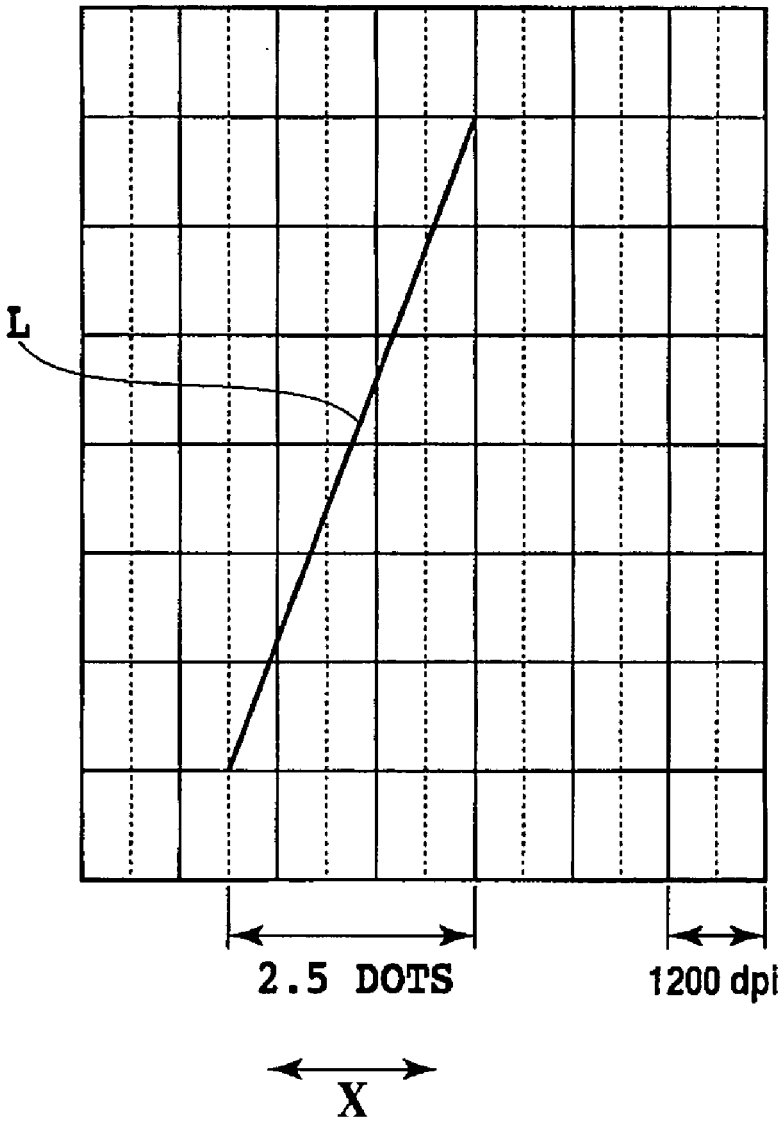
FIG. 16 illustrates the printing result of a ruled line pattern when a nozzle row is inclined by 2.5 dots in the main scanning direction.

FIG. 16 illustrates the nozzle row L inclined with 2.5 dots. In this embodiment, the displacement of the ink adhesion position can be corrected even when the nozzle row is inclined in this manner. Specifically, as described later, a value calculated by a calculating formula is used to determine an optimal correction value of the displacement of the ink adhesion position to reflect the correction value on the image data and the ink ejecting timing, thereby printing an image that maximally suppresses the deterioration thereof.

In the following description, the functional structure of the printing apparatus is considered and thus the minimum unit for correcting image data and an ink ejecting timing is identical to the minimum unit of the driving resolution and the correction of them is performed for every nozzle group obtained by lo dividing a nozzle row.

In this embodiment, when the nozzle row L is inclined with an amount of a multiple of one dot as shown in FIG. 14, then the displacement of the ink adhesion position is corrected in the same manner as that of the above-described embodiment. Specifically, when the nozzle row L is inclined by three dots as in FIG. 14, then the nozzle row La is uniformly divided to three zones (L-1, L-2, and L-3) as in FIG. 15 (i.e., three nozzle groups). Then, the driving timing (ink ejecting timing) of nozzles in the first zone L-1 is not corrected and the driving timing of nozzles in the second zone L-2 is shifted by one dot (which is one time larger than the driving resolution). The driving timing of nozzles in the third zone L-3 is shifted by two dots (which is two times larger than the driving resolution). As a result, as in the above-described embodiment, the displacement of the ink adhesion position is within a width of 1200 dpi as a unit of a driving resolution.

Next, a method for correcting the displacement when the nozzle row is not inclined by one dot as shown in FIG. 16 will be described.

Figure 17:
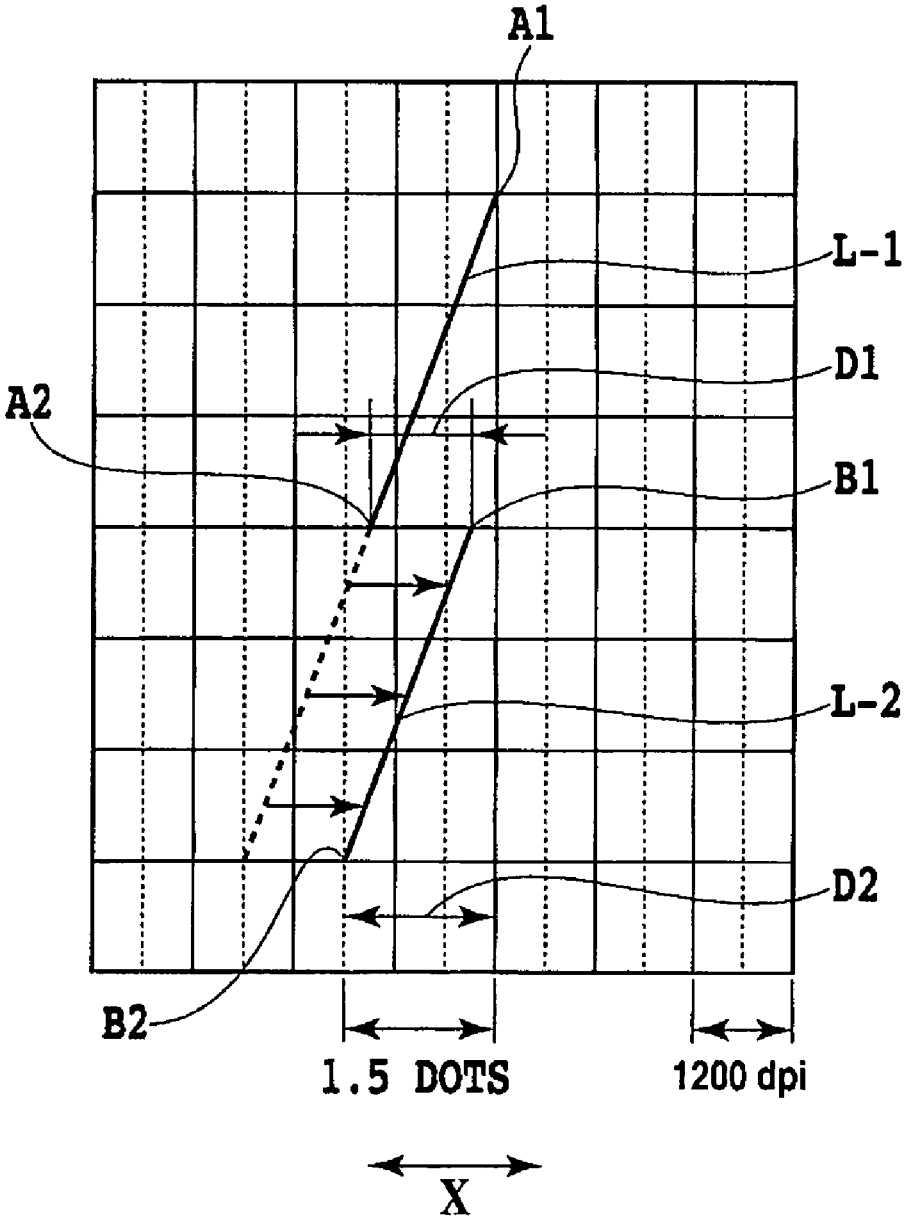
FIG. 17 illustrates the printing result when a nozzle row is divided to two groups to shift a printing timing.
Figure 18:
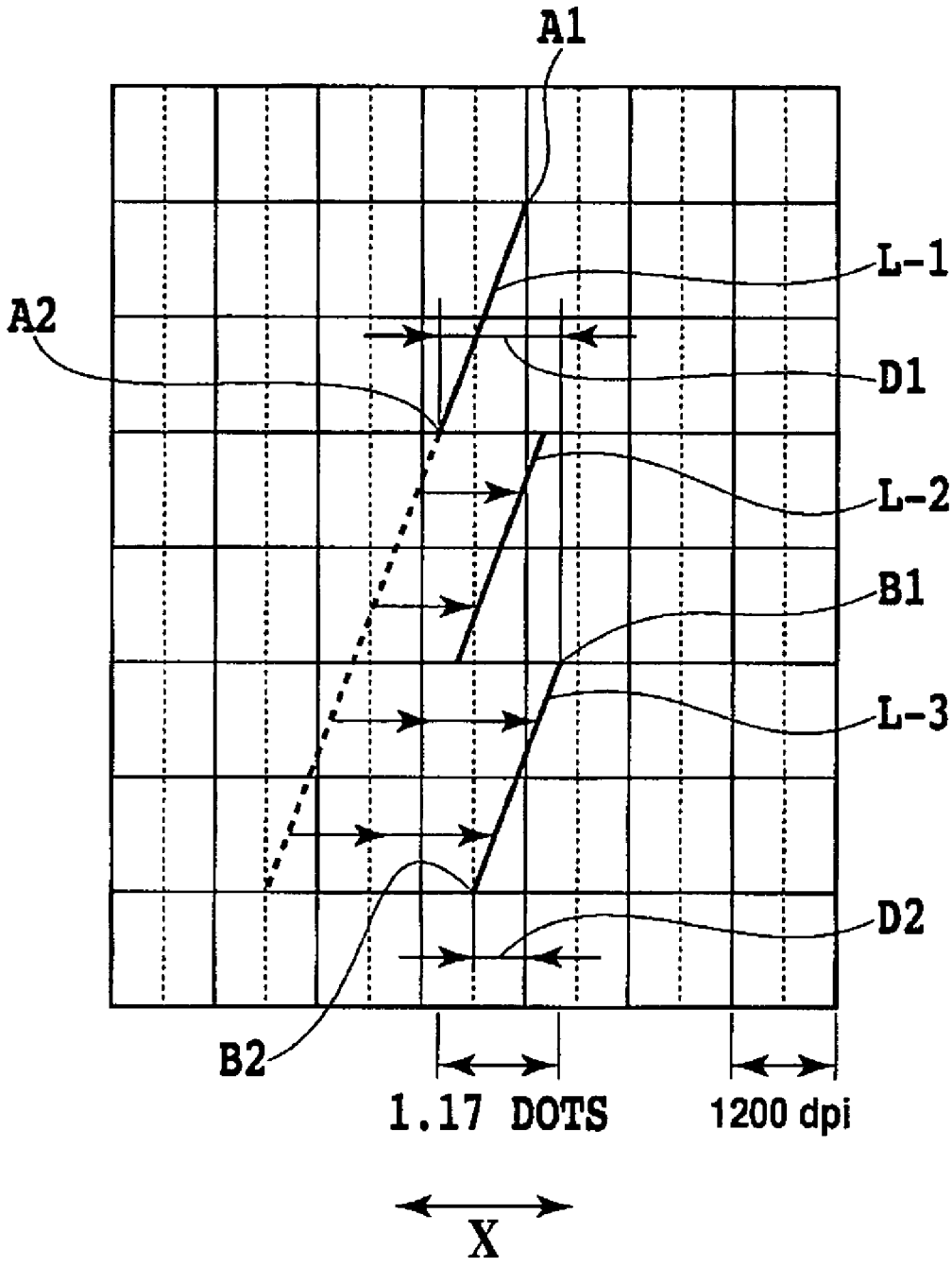
FIG. 18 illustrates the printing result when a nozzle row is divided to three groups to shift a printing timing.

FIG. 17 and FIG. 18 illustrate a case where different corrections are performed when the nozzle row L is inclined by 2.5 dots as shown in FIG. 16. In the case of FIG. 17, the nozzle row L is divided to two zones (L-1 and L-2) (i.e., two nozzle groups) and the driving timings of nozzles in the second zone L-2 are shifted by one dot. On the other hand, in the case of FIG. 18, the nozzle row L is divided to three zones (L-1, L-2, and L-3) (i.e., three nozzle groups) and the driving timings of nozzles in the second zone L-2 are shifted by one dot. The driving timings of nozzles in the third zone L-3 are shifted by two dots.

In the case of FIG. 17, the amount of the displacement of the nozzle row L is within a range of 1.5 dot. In the case of FIG. 18, the amount of the displacement of the nozzle row L is within a range of 1.17 dot. In this manner, the amount of the displacement of the nozzle row L is not within a range of one dot (a width of the minimum unit of the driving resolution). The reason is that the minimum correction amount of the amount of the displacement of the ink adhesion position is a unit of the driving resolution or the resolution of the image data.

Thus, this embodiment determines, even when the inclination amount of the nozzle row L continuously changes, an optimal correction value of the displacement of the ink adhesion position by a value calculated by a calculating formula. In order to set an optimal correction value, the width in the main scanning direction of the ruled line L printed by a printing head having an inclined ejecting opening row is calculated. In the case of this example, the reference position in the main scanning direction is assumed as "0". And, as shown in FIG. 17 and FIG. 18, the position in the main-scanning direction of the tip end dot in the zone L-1 at the tip end side is assumed as A1 and the position in the main scanning direction of the rear end dot in the zone at the tip end side is assumed as A2. In the rear end zone (zone L-2 in FIG. 17 and zone L-3 in FIG. 18), the position of the tip end dot in the main scanning direction is assumed as B1 and the position of the rear end dot in the main scanning direction is assumed as B2. The distance between A2 and B1 in the main scanning direction is assumed as D1 and the distance between A1 and B2 in the main scanning direction is assumed as D2.

These distances D1 and D2 do not depend on the inclination amount of the nozzle row and the number of zones of the nozzle row when a plurality of divided zones have an identical length and can be calculated by the following formulae (1) and (2). In the case of the block driving as shown in FIG. 7A as described above, the number of nozzles included in a nozzle group as one zone is assumed as a multiple of the number of blocks (16 blocks from "a" to "p" in the case of FIG. 6A).

$$D1=A2-B1=a\cdot(2/n-1)+n-1 \quad (1)$$

$$D2=A1-B2=a-(n-1) \quad (2)$$

Here, "a" represents an inclination amount of a nozzle row, "n" represents the number of divided nozzle groups of a nozzle row (i.e., the number of zones).

In the case of FIG. 17, D1 and D2 are calculated in the manner as shown below and the larger value represents a displacement amount of the nozzle row L after the correction.

$$D1=2.5\cdot(2/2-1)+2=1$$

$$D2=2.5-(2-1)=1.5$$

FIG. 17 shows D1<D2 and thus the displacement amount of the nozzle row is within a range of 1.5 dots.

On the other hand, FIG. 18 calculates D1 and D2 in the manner as shown below and the larger value represents a displacement amount of the nozzle row L after the correction.

$$D1=2.5\cdot(2/3-1)+3-1=1.17$$

$$D2=2.5-(3-1)=0.5$$

FIG. 18 shows D1>D2 and thus the displacement amount of the nozzle row is within a range of 1.17 dots.

In this manner, the above formulae (1) and (2) are substituted with the inclination amount "a" of the nozzle row detected by the printing result of a test pattern for example and an arbitrary number n at which the nozzle row is divided. Thus, the displacement amount of the nozzle row after the correction can be estimated. Then, the number n at which the nozzle row is divided that provides the smallest estimated displacement amount is used as an optimal number n at which the nozzle row is divided. Then, driving timings of the respective zones corresponding to the number n at which the nozzle row is divided (ink ejecting timings) are determined as optimal correction values.

As described above, when the nozzle row is inclined with an inclination amount "a" of 2.5 dots, then the number n at which the nozzle row is divided of "2" as in FIG. 17 provides the displacement amount after the correction of 1.5 dots and, the number n at which the nozzle row is divided of "3" as in FIG. 18 provides the displacement amount after the correction of 1.17 dots. Thus, optimal correction values are determined so that the nozzle row is divided to three zones as in FIG. 18 to shift the driving timings of nozzles in the second zone L-2 by one dot and the driving timings of nozzles in the third zone L-3 by two dots. In this case, an optimal maximum correction amount in all zones (L-1, L-2, and L-3) is two dots for the third zone L-3 (which corresponds to two pixels).

Figure 19:
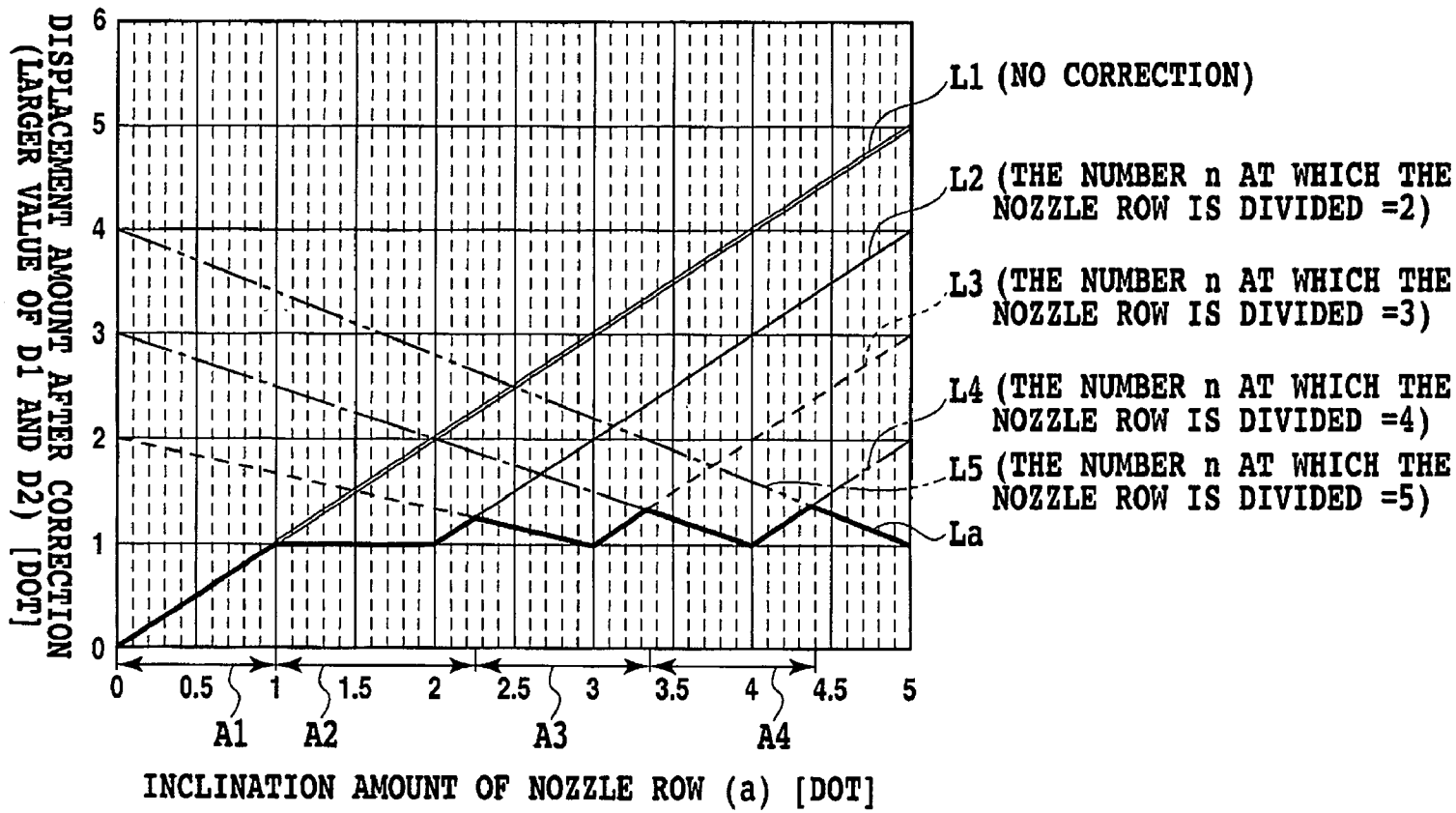
FIG. 19 illustrates a method for determining a correction value in a third embodiment of the present invention.

FIG. 19 illustrates a relation among the inclination amount "a" of the nozzle row that continuously changes, the number n at which the nozzle row is divided, and the displacement amount after the correction. The displacement amount after the correction corresponds, as described above, to the larger value among the values D1 and D2 calculated by the above formulae (1) and (2). In FIG. 19, the double line L1 denotes a displacement amount when no correction is performed, the solid line L2 represents the displacement amount after the correction based on the number n at which the nozzle row is divided is 2, and the dashed line L3 represents the displacement amount after the correction based on the number n at which the nozzle row is divided is 3. The dashed-dotted line L4 represents the displacement amount after the correction based on the number n at which the nozzle row is divided of 4 and the double dashed-dotted line L5 represents the displacement amount after the correction based on the number n at which the nozzle row is divided of 5. The heavy line La represents the minimum displacement amount after the correction in the respective inclination amounts "a". By determining an optimal number n at which the nozzle row is divided so as to realize the displacement amount on this heavy line La, an optimal correction value can be set to correct the displacement amount to the minimum.

As described above, an optimal correction value can be set in accordance with the continuously-changing inclination amount "a" of the nozzle row.

By the way, there may be a case where the continuous inclination amount "a" is relatively difficult to be detected in a general image printing apparatus. In this case, the inclination amount "a" can be detected in a stepwise manner to set a correction value based on the stepwise inclination amount "a".

As can be seen from FIG. 19, the respective correction values corresponding to the number n at which the nozzle row is divided can correspond to the inclination amount "a" in a certain range. For example, when no correction is performed as in the case of the double line L1, the inclination amount "a" corresponds to the range A1 of 0 to 1 dot and, in the case of a correction value when the number n at which the nozzle row is divided is 3 as in the dashed line L3, the inclination amount "a" corresponds to the range A3 of 2.25 to 3.33 dots. The ranges A2 and A4 are ranges corresponding to correction values when the number n at which the nozzle row is divided is 2 and 4, respectively. Hereinafter, the ranges A1, A2, . . . as described above will be collectively called as "corresponding range A".

Figure 20:
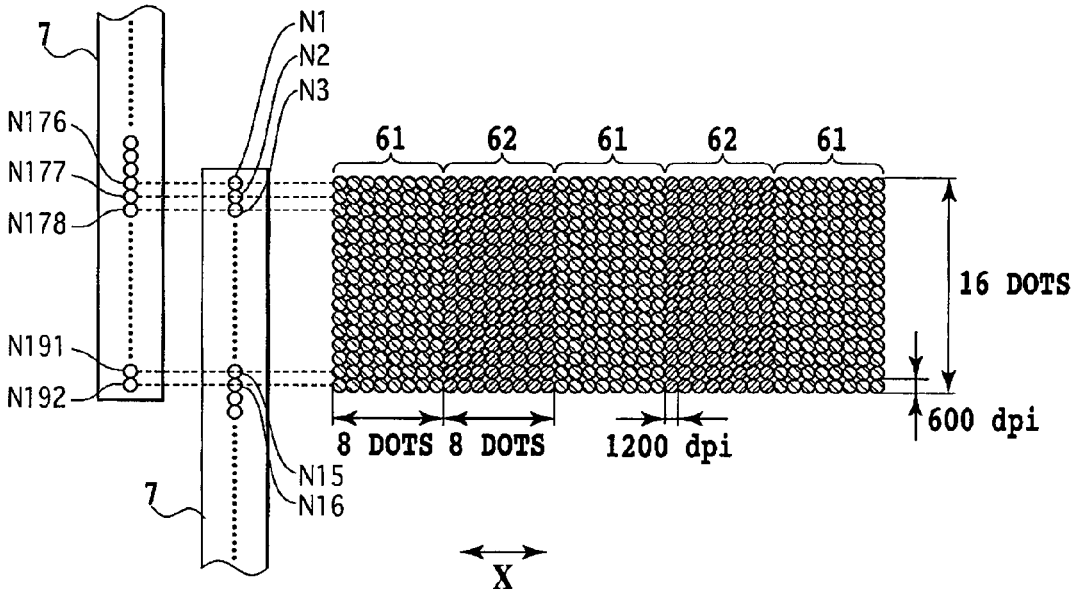
FIG. 20 illustrates a test pattern in the third embodiment of the present invention.

When the inclination amount "a" is detected in a stepwise manner, values in the vicinity of the center of the respective corresponding ranges A also may be detected. The stepwise inclination amount "a" can be inputted, for example, by allowing a user to recognize the printing result of the test pattern as shown in FIG. 20. In this case, center values in the respective corresponding ranges A can be selectively inputted to more clearly switch the number n at which the nozzle row is divided when compared to a case where a value close to a boundary of the corresponding ranges A is inputted.

The test pattern of FIG. 20 is printed, as in the above-described embodiment, by a printing head in which 192 nozzles are arranged with an interval of 600 dpi in the dub scanning direction. Then, the test pattern of FIG. 20 is printed by the upper end nozzle group (nozzles 1 to 16) and the lower end nozzle group (nozzles 176 to 192) of the printing head 7 with a carrier traveling speed of 125 inch/second and a driving frequency of 15 khz. First, the lower end nozzle group is used to form the dots 61 as the respective groups of 8 dots in the main scanning direction with a printing resolution of 1200 dpi and the respective groups of the dots 61 are spaced in the main scanning direction with an interval of 8 dots. Thereafter, at another printing/scanning, the upper end nozzle group is used to form the dots 62 as the respective groups of 8 dots in the main scanning direction with a printing resolution of 1200 dpi and the respective groups of the dots 62 are spaced in the main scanning direction with an interval of 8 dots.

Figure 21:
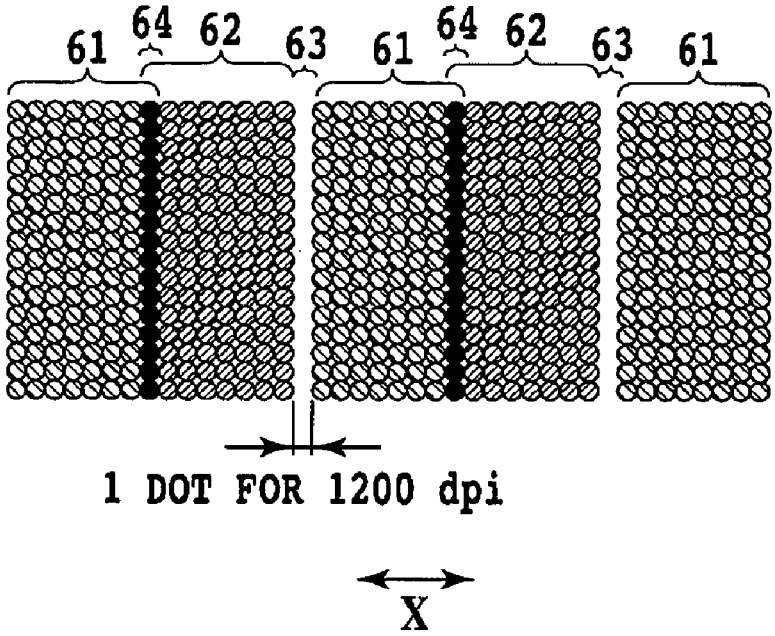
FIG. 21 illustrates the printing result of the test pattern of FIG. 20 when a nozzle row is inclined by one dot.

When this test pattern is printed as shown in FIG. 20 and all dots are arranged uniformly, it can be confirmed that the nozzle row has no inclination. On the other hand, when the region 64 in which dots are superposed and the region 63 in which dots are not provided appear as shown in FIG. 21, an inclination of the nozzle row can be checked in accordance with the level at which they appear. In the case of FIG. 21, it can be confirmed that the nozzle row is inclined by one dot.

Figure 22A:
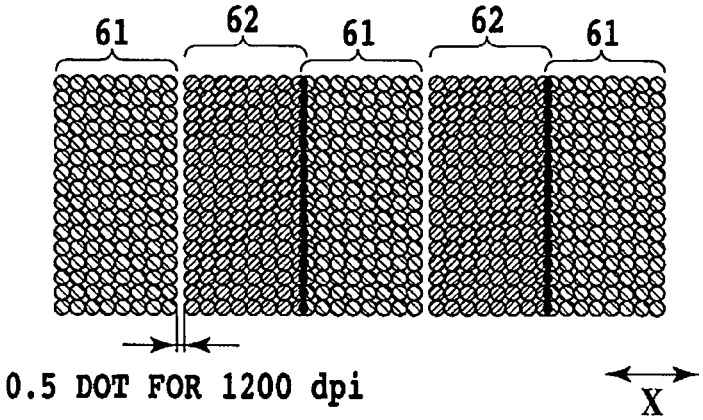
FIGS. 22A and 22B illustrate a test pattern for detecting an inclination of a nozzle row of one dot, respectively.

It is also possible to print, in order to detect an inclination amount of the nozzle row, a test pattern depending on the inclination amount. For example, as a test pattern for detecting an inclination of a nozzle row of 0.5 dot, a pattern as shown in FIG. 22A that is previously shifted by 0.5 dot is printed. Specifically, a driving timing of a nozzle group for forming the dots 62 (ink ejecting timing) is delayed by a half cycle of a driving cycle (ink ejecting cycle).

When the driving frequency (ejecting frequency) is 15 kHz as in this example, a driving timing of a nozzle group for forming the dots 62 (ink ejecting timing) is delayed by 33, 3 μs. As a result, a test pattern as shown in FIG. 22A can be printed in which the dots 62 are displaced in the main scanning direction to the dots 61 by 0.5 dot.

Figure 22B:
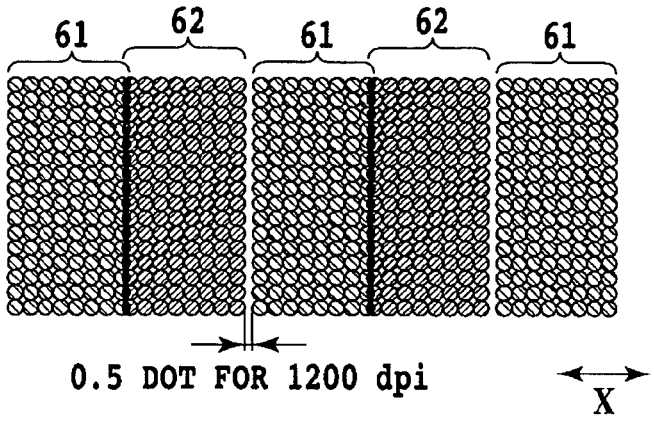
Figure 22C:
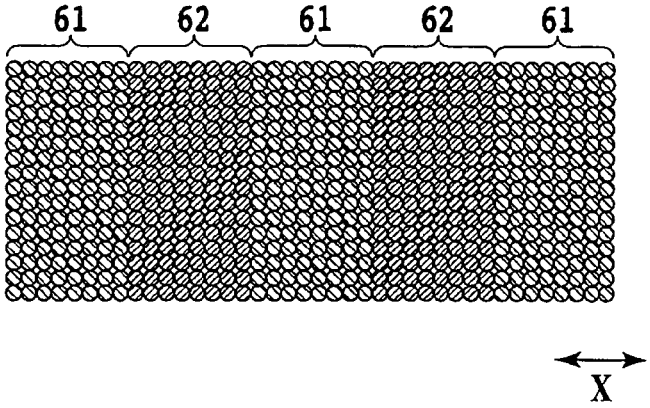
FIG. 22C illustrates the printing result of the test patterns of FIGS. 22A and 22B when a nozzle row is inclined by one dot.

When the nozzle row is inclined in one direction by 0.5 dots in order to print the test pattern of FIG. 22A as described above, the test pattern is consequently printed as shown in FIG. 22C and all dots are arranged uniformly.

FIG. 22B illustrates a test pattern when, contrary to the case of FIG. 22A, the driving timing of the nozzle group for forming the dots 61 is delayed by a half cycle of a driving cycle. When the nozzle row is inclined in the other direction by 0.5 dots in order to print the test pattern of FIG. 22B as described above, the test pattern is consequently printed as shown in FIG. 22C and all dots are arranged uniformly.

As described above, various test patterns can be used to detect an inclination of the nozzle row to determine, based on the detection result, an optimal correction value as described above. FIG. 23 illustrates the result of the comparison of printed images under the three conditions in which the number at which the nozzle row is divided is set like the lines L1, L2, and L3 in FIG. 19 when the inclination amount "a" is 1.8 dots. A printing apparatus having a printing resolution in the main scanning direction of 1200 dpi was used to print images by the 6 pass printing method with the number at which the nozzle row is divided set like the lines L1, L2, and L3. As described above, no correction was performed in the line L1 in FIG. 19, the number n at which the nozzle row is divided was set as 2 in the line L2 to determine a correction value, and the number n at which the nozzle row is divided was set as 3 in the line L3 to determine a correction value. Images were printed under the three types of printing conditions to compare the roughness levels of the printed images.

The comparison showed that the smallest roughness was obtained when the number n at which the nozzle row is divided was set as 2 like the line L2 in FIG. 19. The line L2 is on the line La when the inclination amount "a" is 1.8 dots as shown in FIG. 19. Thus, the correction value could be determined based on the line La to optimally correct the displacement.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application No. 2005-200146 filed Jul. 8, 2005, and Japanese Patent Application No. 2006-171692 filed Jun. 21, 2006, which are hereby incorporated by reference herein.

What is claimed is:

1. An ink jet printing apparatus for printing an image on a printing medium by using a printing head having a nozzle row in which a plurality of nozzles that can eject ink are arranged to repeat a scanning and a transportation operation, the scanning being performed for causing the nozzle to eject ink while moving the printing head in a main scanning direction and the transportation operation being performed for transporting the printing medium in a sub scanning direction crossing the main scanning direction, the ink jet printing apparatus comprising:

setting means for setting a number by which the nozzle row is divided for dividing a plurality of nozzles constituting the nozzle row into a plurality of divided nozzle groups in accordance with a displacement amount in the main scanning direction between a first printed image printed, during a first scanning, by a first nozzle group including a plurality of nozzles positioned at one end side of the nozzle row and a second printed image printed, during a second scanning different from the first scanning, by a second nozzle group including a plurality of nozzles positioned at the other end side of the nozzle row; and correcting means for correcting a printing position on the basis of the divided nozzle groups divided in accordance with the number set by said setting means.

2. The ink jet printing apparatus according to claim 1, wherein a relation among driving timings of a plurality of nozzles included in the first nozzle group is identical to a relation among driving timings of a plurality of nozzles included in the second nozzle group.

3. The ink jet printing apparatus according to claim 1, wherein:

the plurality of nozzles constituting the nozzle row constitute a plurality of driving blocks including a plurality of nozzles, for which nozzles included in each driving block are driven with an identical driving timing and the first nozzle group and the second nozzle group constitute those nozzle groups among the plurality of driving blocks having a longest distance therebetween.

4. The ink jet printing apparatus according to claim 1, wherein:

the first nozzle group and the second nozzle group do not include a nozzle positioned at the farthest end of the nozzle row.

5. The ink jet printing apparatus according to claim 1, further including:

detection means for detecting a displacement amount of the first printed image and the second printed image with a reading resolution half of a printing resolution in the main scanning direction of the first printed image and the second printed image, wherein the setting means sets the number by which the nozzle row is divided based on the displacement amount detected by the detection means.

6. The ink jet printing apparatus according to claim 5, wherein:

the setting means sets, in accordance with a displacement amount N detected by the detect ion means on the basis of the reading resolution, the number by which the nozzle row is divided to be N×2.

7. The ink jet printing apparatus according to claim 1, further including:

detection means for detecting a displacement amount of the first printed image and the second printed image with a reading resolution identical with the printing resolution in the main scanning direction of the first printed image and the second printed image, wherein the setting means sets the number by which the nozzle row is divided based on the displacement amount detected by the detection means.

8. The ink jet printing apparatus according to claim 7, wherein:

the setting means sets, in accordance with a displacement amount M detected by the detection means on the basis of the reading resolution, the number by which the nozzle row is divided to be M (M is a number other than 1(one)).

9. The ink jet printing apparatus according to claim 1, wherein:

the setting means sets, in accordance with an inclination amount of the nozzle row in the main scanning direction, the number by which the nozzle row is divided.

10. The ink jet printing apparatus according to claim 9, wherein:

the setting means sets the number by which the nozzle row is divided depending on the inclination amount of the nozzle row based on a correspondence between a continuously-changing inclination amount of the nozzle row and the number by which the nozzle row is divided.

11. The ink jet printing apparatus according to claim 9, wherein:

the setting means uses a larger value of D1 and D2 values determined by a formula shown below as a determination value and sets a value n at which the determination value is minimum as the number by which the nozzle row is divided, $$D1=a\cdot(2/n-1)+n-1,$$

and $$D2=a-(n-1)$$

where "a" represents an inclination amount of a nozzle row on the basis of a printing resolution in the main scanning direction, and "n" represents a number by which the nozzle row is divided.

12. The ink jet printing apparatus according to claim 1, wherein:

the plurality of nozzles constituting the nozzle row constitute a plurality of driving blocks including a plurality of nozzles for which nozzles included in each driving block are driven with an identical driving timing, and the number of nozzles included in the first nozzle group and the second nozzle group is a multiple of the number of nozzles constituting the driving block.

13. The ink jet printing apparatus according to claim 1, wherein:

the plurality of nozzles constituting the nozzle row constitute a plurality of driving blocks including a plurality of nozzles for which nozzles included in each driving block are driven with an identical driving timing, a predetermined printing region on the printing medium is set with a multi pass printing mode for scanning the printing head a plurality of times to print an image, and the printing medium is transported in the sub scanning direction in the multi pass printing mode with a transportation amount that is a multiple of a printing width of nozzles constituting the driving block.

14. The ink jet printing apparatus according to claim 1, wherein:

the correcting means shifts, based on an order of the plurality of divided nozzle groups from one end side to the other end side of the nozzle row, driving timings of the plurality of divided nozzle groups by the printing resolution.

15. The ink jet printing apparatus according to claim 1, wherein:

the correcting means shifts, based on an order of the plurality of divided nozzle groups from one end side to the other end side of the nozzle row, printing data allocated to the plurality of divided nozzle groups by the printing resolution.

16. An ink jet printing method for printing an image on a printing medium by using a printing head having a nozzle row in which a plurality of nozzles that can eject ink are arranged to repeat a scanning and a transportation operation, the scanning being performed for causing the nozzle to eject ink while moving the printing head in a main scanning direction and the transportation operation being performed for transporting the printing medium in a sub scanning direction crossing the main scanning direction, the ink jet printing method comprising the steps of:

printing a first printed image, during a first scanning, by a first nozzle group including a plurality of nozzles positioned at one end side of the nozzle row and a second printed image, during a second scanning different from the first scanning, by a second nozzle group including a plurality of nozzles positioned at the other end side of the nozzle row;

setting, in accordance with a displacement amount in the main scanning direction of the first printed image and the second printed image, a number by which the nozzle row is divided for dividing the plurality of nozzles constituting the nozzle row into a plurality of divided nozzle groups; and correcting a printing position on the basis of the divided nozzle groups divided by the number set in said setting step.

* * * * *

UNITED STATES PATENT AND TRADEMARK OFFICE

CERTIFICATE OF CORRECTION

PATENT NO. : 7,344,219 B2
APPLICATION NO. : 11/480556
DATED : March 18, 2008
INVENTOR(S) : Sakamoto et al.

It is certified that error appears in the above-identified patent and that said Letters Patent is hereby corrected as shown below:

COLUMN 3:
Line 15, “first a” should read --a first--.

COLUMN 5:
Line 5, “FIG. 1C, FIG. 1D,” should read --FIG. 11C, FIG. 11D,--.
Line 46, “EMBODIMENT” should read --EMBODIMENTS--.

COLUMN 6:
Line 41, “(LinePer” should read --(Lines Per--.

COLUMN 10:
Line 36, “dotsb” should read --dots b--.

COLUMN 13:
Line 2, “patter” should read --pattern--.
Line 8, “an” should read --a--.
Line 32, “a” should read --an--.

COLUMN 14:
Line 21, “(iii))” should read --(iii)--.

COLUMN 15:
Line 29, “dots” should read --dot--.
Line 38, “FIG. 1D,” should read --FIG. 11D,--.
Line 52, “FIG. 1E,” should read --FIG. 11E,--.

COLUMN 16:
Line 34, “a” should read --an--.
Line 64, “above,” should read --above.--.

COLUMN 17:
Line 24, “(iii))” should read --(iii)--.

COLUMN 18:
Line 13, “lo” should be deleted.
Line 65, “main-scanning” should read --main scanning--.

UNITED STATES PATENT AND TRADEMARK OFFICE

CERTIFICATE OF CORRECTION

PATENT NO. : 7,344,219 B2
APPLICATION NO. : 11/480556
DATED : March 18, 2008
INVENTOR(S) : Sakamoto et al.

It is certified that error appears in the above-identified patent and that said Letters Patent is hereby corrected as shown below:

COLUMN 21:
Line 50, "FIG. 23" should read --¶ FIG. 23--.

COLUMN 22:
Line 54, "timing" should read --timing,--.

COLUMN 23:
Line 9, "detect ion" should read --detection--.

Signed and Sealed this

Third Day of March, 2009

JOHN DOLL
*Acting Director of the United States Patent and Trademark Office*